US010197254B2

(12) United States Patent
Crandell et al.

(10) Patent No.: US 10,197,254 B2
(45) Date of Patent: Feb. 5, 2019

(54) STRUT LIGHT SYSTEM WITH INTEGRATED LIGHT SOURCE

(71) Applicant: Walthill Opportunities L.L.C., St. Louis Park, MN (US)

(72) Inventors: William Todd Crandell, Minnetonka, MN (US); Benjamin S. Arriola, Deephaven, MN (US)

(73) Assignee: Walthill Opportunities, L.L.C., St. Louis Park, MN (US)

( * ) Notice: Subject to any disclaimer, the term of this patent is extended or adjusted under 35 U.S.C. 154(b) by 0 days.

(21) Appl. No.: 15/892,711

(22) Filed: Feb. 9, 2018

(65) Prior Publication Data

US 2018/0224103 A1 Aug. 9, 2018

Related U.S. Application Data

(60) Provisional application No. 62/457,113, filed on Feb. 9, 2017.

(51) Int. Cl.
*F21V 21/34* (2006.01)
*F21V 17/04* (2006.01)
(Continued)

(52) U.S. Cl.
CPC ..... *F21V 21/34* (2013.01); *F21V 17/04* (2013.01); *F21V 17/162* (2013.01);
(Continued)

(58) Field of Classification Search
CPC ..... F21V 21/025; F21V 21/34; F21V 21/03; F21V 17/04; F21V 17/162; F21V 23/002;
(Continued)

(56) References Cited

U.S. PATENT DOCUMENTS 5,984,486 A 11/1999 Munz et al.
6,357,904 B1 3/2002 Kawashima
(Continued)

OTHER PUBLICATIONS

Unistrut Channel for Mounting LED Lighting Brochure "Led lighting installation has never been easier." 1 page.
(Continued)

*Primary Examiner* — Laura Tso
(74) *Attorney, Agent, or Firm* — Christensen, Fonder, Dardi & Herbert PLLC

(57) ABSTRACT

A ceiling grid system formed of struts has a plurality of elongate insert light units. The grid system suspended from the ceiling and comprising a multiplicity of steel elongate channels (struts) arranged in the grid. The channels having a downwardly directed U-shape and defining an opening and an open channel interior, the channel having opposing J-shaped wall portions, each wall portion with an inwardly directed curved lip portion defining a gap width therebetween the two wall portions. The elongate insert light units seated within one of the steel elongate channels, each insert light unit having an elongate body with a light emitting side, each insert light unit comprising a housing, and a strip of light emitting diodes, and a transmission portion at the light emitting side, the body retained in the interior of the channel, each light unit removable and replaceable with the respective channel.

20 Claims, 24 Drawing Sheets

(51) Int. Cl.

| | |
|---|---|
| ***F21V 17/16*** | (2006.01) |
| ***F21V 21/03*** | (2006.01) |
| ***F21V 23/00*** | (2015.01) |
| ***F21V 23/02*** | (2006.01) |
| ***F21V 21/005*** | (2006.01) |
| *F21Y 103/10* | (2016.01) |
| *F21Y 115/10* | (2016.01) |

(52) U.S. Cl.
CPC ..... *F21V 21/005* (2013.01); *F21V 21/03* (2013.01); *F21V 23/002* (2013.01); *F21V 23/02* (2013.01); *F21Y 2103/10* (2016.08); *F21Y 2115/10* (2016.08)

(58) Field of Classification Search
CPC ... F21V 23/02; F21Y 2103/10; F21Y 2115/10
USPC ..... 362/648, 659, 249.02
See application file for complete search history.

(56) References Cited

U.S. PATENT DOCUMENTS

| | | | | |
|---|---|---|---|---|
| 6,641,284 | B2 | 11/2003 | Stopa et al. | |
| 6,871,983 | B2 | 3/2005 | Jacob et al. | |
| 6,880,952 | B2 | 4/2005 | Kiraly et al. | |
| 7,645,052 | B2 | 1/2010 | Villard | |
| 7,674,010 | B2 | 3/2010 | Griffiths et al. | |
| 7,810,955 | B2 | 10/2010 | Stimac et al. | |
| 7,854,527 | B2 | 12/2010 | Anderson | |
| 7,887,220 | B2 | 2/2011 | Wu et al. | |
| 8,083,370 | B2 * | 12/2011 | Sloan | F21K 9/00 362/219 |
| 8,104,920 | B2 * | 1/2012 | Dubord | F21S 2/005 362/217.12 |
| 8,568,008 | B2 * | 10/2013 | Yoshida | B60Q 3/76 362/311.02 |
| 8,616,720 | B2 | 12/2013 | Carney et al. | |
| 8,764,220 | B2 | 7/2014 | Chan et al. | |
| 8,899,780 | B2 | 12/2014 | Maxik et al. | |
| 8,979,299 | B2 | 3/2015 | Hsia et al. | |
| 9,103,508 | B2 * | 8/2015 | Shimizu | F21V 15/015 |
| 9,121,597 | B2 | 9/2015 | Snagel et al. | |
| 9,157,622 | B2 * | 10/2015 | Yanping | F21V 21/30 |
| 9,163,812 | B2 | 10/2015 | Thomas et al. | |
| 9,228,708 | B2 | 1/2016 | Dings et al. | |
| 9,261,258 | B2 | 2/2016 | Sears | |
| 9,285,085 | B2 | 3/2016 | Carney et al. | |
| 9,388,969 | B2 * | 7/2016 | Doubek | F21V 17/164 |
| 9,441,824 | B2 | 9/2016 | Kinnune et al. | |
| 9,476,552 | B2 | 10/2016 | Myers et al. | |
| 9,516,818 | B2 | 12/2016 | Aikala | |
| 9,518,706 | B2 | 12/2016 | Chan et al. | |
| 2010/0214770 | A1 | 8/2010 | Anderson | |
| 2010/0284181 | A1 | 11/2010 | O'Brien et al. | |
| 2011/0090681 | A1 | 4/2011 | Hobson et al. | |
| 2011/0286207 | A1 | 11/2011 | Chan et al. | |
| 2011/0310614 | A1 | 12/2011 | Budike, Jr. | |
| 2012/0081899 | A1 | 4/2012 | Yu | |
| 2012/0155095 | A1 | 6/2012 | Ryan, Jr. | |
| 2012/0319616 | A1 | 12/2012 | Quilici et al. | |
| 2013/0343050 | A1 | 12/2013 | Hu | |
| 2014/0009922 | A1 | 1/2014 | Zhang et al. | |
| 2014/0177219 | A1 | 6/2014 | Treto et al. | |
| 2014/0362574 | A1 | 12/2014 | Barrett | |
| 2015/0192280 | A1 | 7/2015 | Thomas et al. | |
| 2015/0241051 | A1 | 8/2015 | Ruud et al. | |
| 2016/0003464 | A1 | 1/2016 | Thomas et al. | |
| 2016/0327217 | A1 | 11/2016 | Pearson et al. | |
| 2016/0327249 | A1 | 11/2016 | Pearson et al. | |
| 2017/0336064 | A1 * | 11/2017 | Simon | F21V 21/025 |

OTHER PUBLICATIONS

Unistrut General Engineering Catalog—No. 17A (2017) *Atkore International, Inc. US-L-1000-1702* 242 pages.
4DVP-17 B-Line Series Strut Support System—4Dimension Strut System "Changing how we build our future" *Eaton* (Sep. 2017) 6 pages.
22DP Straight & Narrow Gen II—SpecSheet Staging Architectural Suspended; downloaded from the interest at www.cooperlighting.com on (Jul. 25, 2011) 2 pages.
SNLED-LD5 Brochure "SNLED Series Linear LED Striplight" *Eaton* (Jul. 9, 2018) 4 pages.
HUGO—HGL Frosted Lens—LED Suspended Direct; downloaded from the internet at www.eaton.com/lighting on (Apr. 6, 2018) 2 pages.
XE Family LED Enclosed & Gasketed Luminarires Installation Instructions (2015) 3 pages.
XE Family LED Enclosed & Gasketed Luminarires Brochure (Dec. 2015) 2 pages.
Rosalind Pumphrey, "The importance of BIM in the lighting industry" *Eaton* (May 2015) 3 pages.

* cited by examiner

STRUT LIGHT SYSTEM WITH INTEGRATED LIGHT SOURCE

This application claims priority to U.S. Patent Application No. 62/457,113, filed Feb. 9, 2017, the contents of which are incorporated herein by reference in its entirety for all purposes.

FIELD OF THE INVENTION

The present invention relates to the general construction of building systems internal mechanical support structure and the general lighting in open ceiling areas of industrial and commercial spaces that incorporate the building systems mechanical support structure. More specifically, the present invention relates to the design, installation and construction of a structural lighting system that seamlessly integrates into the building support structure commonly used in open ceiling spaces, generally comprised of structural channel systems, that supports the building systems mechanical, electrical and plumbing (MEP).

BACKGROUND OF THE INVENTION

Structural channel members, commonly known as strut channel, are used ubiquitously in industrial and commercial spaces to provide mechanical support for building mechanical, electrical, and plumbing (MEP) as well as, communication cabling and other ceiling mounted building system components. Examples of these structural channel mechanical support systems include Unistrut™, Eaton B-Line™ and other similar branded and unbranded systems. Often structural channel systems are used in open ceiling structures in back rooms, hallways and basement mechanical rooms as well as other open ceiling areas of buildings. In these applications, the areas containing structural channel systems have general lighting supplied by a variety of non-specific lighting fixtures ranging from simple A Lamp type fixtures to vapor tight linear fixtures as well as many other common fixture forms. The most common fixtures used for open ceiling lighting include track lighting with spot lights, linear vapor tight fixtures and open linear fluorescent strip fixtures commonly utilizing T12-T5 linear fluorescent tubes and more recently, LED lighting sources.

The structural channel members or strut channel for these areas are selected and specified to safely support specific carrying loads for building system components. All mechanical loads attached to the structural channels increase the sizing of the structural members and associated mounting hardware. Any additional light fixture structure suspended from the strut channel structure is therefore included in these load calculations, thus reducing the carrying capacity of the overall mechanical structure. Additional load from light fixtures, electrical track light buss systems and other supporting components, such as cabling or pendant mount hardware, reduce the system mechanical load carrying capacity by tens to hundreds of pounds per section and potentially thousands of pounds over a full ceiling space. While the structural channels are specified to carry these additional loads, additional structural channel or larger, stronger structural members must be specified to accommodate the addition of lighting system loads thereby increasing costs for materials, installation time, and incidental project-related, schedule-driven costs and overhead.

Critical to the specifications of these spaces is head room or clearance for fixed and moveable equipment such as furnaces, boilers, server equipment, pumps or other common equipment found in mechanical and electrical rooms as well as physical room for workers or occupants to work in or pass through an area. Hallways in basements or industrial spaces are another common area where insufficient head room for equipment and personnel can be an issue. The head room in these spaces can be greatly reduced by the addition of lighting fixtures. Architects and designers are forced to adjust building layouts to move plumbing, electrical conduit, HVAC ducting and other building mechanical, electrical and plumbing system components to the corners of hallways, along the walls, or into other areas in order to accommodate the design space necessary for the lighting. Construction of mechanical, electrical and plumbing systems must accommodate lighting fixtures and often require routing of multiple parallel conduits, pipes or HVAC duct work. These multiple parallel routing paths result in extra bends in piping or conduit and faceting of sheet metal vents which are extremely time consuming and expensive for electrical contractors to install, negatively impacting project costs and schedules. Engineers and designers are faced with significant design challenges when determining routing for the mechanical and electrical systems while still meeting building code requirements for MEP routing, and lighting these spaces further negatively effects project schedule and costs.

Where building system components cannot be moved to accommodate the lighting fixture and still meet head space requirements, light fixtures are placed higher up in the open ceiling space resulting in significantly obstructed lighting with either poor light levels and/or non-uniform lighting, with significant shadowing from the building system components suspended below the lighting fixtures. The obstructed lighting further leads to building energy inefficiencies as higher-light level, higher-energy consumption fixtures must be specified in order to meet minimum floor level or working area light level requirements.

Due to the complexity of MEP routing, the lighting fixtures for the areas are often difficult to specify and are either left unspecified or generically specified during the building design process. The fixtures ultimately used are frequently not optimized for headroom, lighting performance, energy consumption or installation costs. Lighting fixtures used frequently provide either ineffective lighting or excess lighting resulting in poor lighting or inefficient energy designs. Insufficient uniform lighting due to shadowing or obstructed light creates dark spaces and the need for additional secondary or temporary lighting (I.e. (i.e., utility lights, head lamps or flash lights), further leading to building energy inefficiencies and increased operational costs.

Lighting fixtures added to open ceiling space are frequently painted or otherwise designed to conceal the fixture to minimize the undesired aesthetic impact on the space. Particularly in open ceiling designs, pendant and other fixture styles that hang down from the ceiling are often painted to match the ceiling or surrounding walls to try to prevent the fixture from breaking up sightlines in a space. These approaches are generally a compromise by the architect or designer and have minimal beneficial effect as the fixture structure will still block visual sightlines, impact daylighting effectiveness, and obstruct preferential views of artwork, windows, signage, emergency exits, etc., as well as block access to observe essential building electrical and mechanical systems.

The Lighting fixtures added to any space inherently add cost and time to install due to the need for additional hanging structure and electrical components necessary for the fixtures. Companies selling strut channel often provide elaborate and expensive systems for mounting lighting fixtures and routing wiring for power connection. Many of the solid-state lighting ("SSL") fixtures used for better energy efficiency come with additional—non-standard—mounting hardware or methods. Installation time and costs are increased due to unfamiliarity with mounting the fixture by the electrical contractor or due to the need to source uncommon components necessary for mounting the light fixtures. Even traditional light fixtures require additional hangers and hardware not otherwise used by the Electrical or Mechanical Contractor in normal assembly of the ceiling space. Companies providing strut channel frequently offer a vast array of additional hangers and components for mounting suspended light fixtures, routing wiring and making power connections; all of which increase system weight, add cost and create aesthetic tradeoffs. SSL lighting fixtures and lighting fixtures in general used in open ceiling spaces tend to be inherently fragile in nature. Lens or optics are typically exposed, thin, brittle plastic and housings manufactured from thin sheet metal, plastic or aluminum extrusions that may be easily bent or damaged when handled by workers using tools and mechanical components when installing or repairing building mechanical or electrical systems, often routed in ceiling adjacent to or above the lighting fixtures. Mechanical damage to light fixtures, particularly in mechanical rooms and other industrial spaces is common, requiring full fixture or lens replacement to repair the lighting fixture and increasing fixture costs or schedule delays on projects or increasing maintenance costs for facilities.

Lighting fixtures in open ceiling food preparation areas carry a separate set of requirements in addition to having head space and fixture locations requirements, fixture access for cleaning is critical. Lighting fixtures added to support channels and frame members within food preparation spaces inherently block access for cleaning as well as create potential pockets and dead spaces above the lighting fixtures or between lighting and support structures.

Generally speaking, SSL technology has been adopted to many traditional fixtures to make improvements in energy efficiency of light fixtures used in open ceiling space applications. SSL solutions have been developed extensively for vapor tight and linear fluorescent type fixtures, again for the benefit of energy savings. SSL technology has not been as effectively applied to the problems with traditional fixtures as stated above relating to head space, loading, aesthetics and sightline obstruction and many of the solutions still use traditional or more complicated mounting systems, again adding extra costs and assembly time.

There is therefore, a general need for a lighting system providing the utility of meeting both the structural requirements of the building mechanical, electrical and plumbing systems structural support as well as meeting the general lighting requirements of the intended spaces. This need is particularly found in industrial and mechanical spaces with open ceiling construction and in open ceiling construction with low ceilings with supporting building mechanical, electrical and plumbing systems. Further, there is a general need for a lighting system with the added benefits of meeting lighting design, space aesthetics, performance and efficiency requirements intended by designers and architects without the negative tradeoffs of currently available and traditional lighting systems.

SUMMARY OF THE DISCLOSURE

Embodiments herein provide an SSL lighting system, light units, fixture assemblies, retrofit methods, and assembly methods associated with, or that replace the structural channel structure commonly used in industrial, retail and commercial open ceiling applications. Embodiments of an SSL lighting fixture includes a lighting circuit, housing, optics, sealing mechanism, drive circuit, strut channel mechanical structure, and related electrical connection and mounting hardware system.

The SSL lighting system, in certain embodiments, replaces portions of existing open ceiling structural channel mechanical support structures and eliminates the need for additional, traditional mounted, recessed or pendant type lighting fixtures. The SSL system includes one or more SSL lighting fixtures mounted through traditional structural channel mounting approaches. The SSL lighting system incorporates low voltage electrical power supplies, wiring and electrical connections to power the SSL lighting fixtures throughout the SSL system. The SSL lighting system, in certain embodiments, installs directly into existing open ceiling structural channel mechanical support structures and eliminates the need for additional, traditional mounted, recessed or pendant type lighting fixtures. The SSL lighting system includes one or more SSL Light Unit 10 or subassemblies mounted through the structural channel opening or open end without disruption to the traditional mounting methods used with the structural channels. The SSL lighting system, when installed either as an SSL light fixture assembly or as a SSL light module subassembly kit in an open ceiling structure, makes it possible to realize several benefits over standard lighting fixture designs and structural channel ceiling structures.

The SSL lighting fixture mechanical design includes one or more SSL Light Subassemblies 20 and adds no appreciable additional weight to the structural member due to addition of a light fixture structure. The only additional weight required to consider for loading calculations is the optimized minimal weight of the subassembly light strip, heat sink and optics, thus optimizing the structural loading available capacity of the structural member to its absolute maximum for a structure including a ceiling mounted or suspended lighting system.

This SSL lighting fixture mechanical and lighting circuitry adds no additional height to the structural channel member. The SSL lighting system achieves ideal lighting performance while fully-contained within the mechanical structural elements. The available space for headroom or mechanical, electrical or plumbing system routing is therefore optimized to its absolute maximum for a structural channel ceiling system with lighting.

The fixture mechanical construction allows lighting to be positioned as required in the space (e.g., centered on a hallway) for achieving efficient and effective lighting of the space additionally, without any limitation to the placement or routing of mechanical, electrical or plumbing system components due to interference with the lighting system, thus effectively increasing the available space for routing of mechanical, electrical or plumbing system components. The SSL lighting system can be placed below building system MEP and mechanical open ceiling structure, thus minimizing the obstruction of the lighting from building MEP components. Energy consumption and lighting performance are optimized for the space and likewise not impacted negatively by the routing design for mechanical, electrical and plumbing system components.

This SSL lighting system maintains the aesthetics of the open ceiling architectural design with no additional impact on the visual sightlines, daylighting effectiveness or preferential views of artwork, windows, exits or signage. Visual impact on gauges, indicators and computer screens as well as other informative building system devices is optimized to an absolute minimum for a structural channel, open ceiling lighting system. Lighting performance for viewing of gauges, indicators, computer screens and other building system devices is also optimized due to elimination of shadowing from mechanical, electrical or plumbing building system components or associated mounting hardware.

The SSL lighting system provides a specified or unspecified lighting option for Electrical, Mechanical and General Contractors, as well as specifying Architects, that provides an optimized lighting and energy saving solution for maintaining project budgets and schedules, without sacrificing lighting performance, energy consumption or safety. Light fixture installation time and cost is minimized utilizing existing structural channel mounting hardware with no additional hardware required beyond the hardware already required for mounting of the structural channel.

This SSL Light Subassembly 20 is fully self-contained within the common structural channel. The structural channel providing features for mounting, as well as additional heat sinking if required, for the SSL electrical circuit for effective operation. The SSL light fixture subassembly and fixture structural channel further provides full protection for the SSL electrical circuit and optics assembly from mechanical, environmental or electrical damage. The protection provided by the structural channel and fixture design and mounting system eliminates the need to replace damaged light fixture lenses or full fixtures damaged during installation or maintenance of adjacent mechanical, electrical or plumbing systems.

The SSL Fixture Subassembly (or module) includes the SSL lighting, electrical, housing and optical system and accommodates assembly of the SSL fixture subassembly within a novel structural channel or common strut channel structural members with openings allowing use in any strut channel ceiling structure. The SSL fixture subassembly system circuit, electrical design and optics design have been optimized within the lighting fixture subassembly, within the mechanical constraints of the strut channel configurations, and utilize mechanical mounting components allowing for installation through open face or open end of or common strut channel structures. Further enhancements and improvements of lighting efficiency and optics efficiency of the mechanical, electrical and optical light fixture can be achieved through modification of the standard strut channel openings and spacing in combination with electrical circuit and optics designs.

The electrical, housing and optical subassembly optimizes lighting efficiency and effectiveness in a strut channel ceiling structure by eliminating shadowing and dark areas resulting from pendant mount or recessed lighting systems, optimizing coefficient of utilization of the light fixture. Further, the fixture design accommodates up lighting, side lighting and down lighting solutions utilizing common strut channel construction and thereby reducing or eliminating the need for and costs associated with secondary lighting such as additional wall mounted light fixtures, worker head lamps, flashlights, or utility lights. Further, the optical system provides optimized uniform lighting in narrow, wide or batwing arrangements.

The SSL lighting fixture assembly can be constructed to provide up, side or down lighting configurations, as well as construction providing centered or offset SSL subassembly lighting solutions. Offset SSL subassembly construction provides for alternate aesthetic lighting design effects, as well as optimization of routing designs for building system components. The impact on routing spaces for a 10' W×8' H hallway resulted in a 22-33% increase in available routing space by utilizing the SSL light fixture assembly over traditional vapor tight or 2'×4' fluorescent troffer light fixtures. A 144%-166% increase in available routing space can be gained if the routing design requires continuous adjacent routing of building system components.

The impact on available vertical routing space for a 10'W×8'H hallway resulted in a 128% increase gained assuming a 1' available routing space and a typical 6.75" deep vapor tight fixture. Alternate light fixture comparisons and ceiling height constraints would provide differing results, however; in all scenarios, the SSL light fixture assembly provides equal or an improved routing area. Routing volume (product of increased horizontal routing and vertical routing spaces) further demonstrates the improvement of routing space for building system components as a result of using the SSL light assembly fixture.

The SSL light fixture assembly when installed in open ceiling food preparation areas improves fixture access for cleaning by eliminating blocked access from installed traditional light fixtures. Further, the SSL Lighting Subassembly in one embodiment can be adapted to include UV up lighting for germicidal sanitation and cleansing. The SSL Light Subassembly 20 further includes full seals and structure to withstand pressure washing required in cleansing of food preparation areas.

The impact on pipe routing times and costs was estimated by a certified electrician to be 12 hours on average for a bend pipe application consisting of 9×90-degree double bends to route around a space for a light fixture. By using embodiments herein, the pipes, according to the certified electrician, could be routed straight and the entire 12 hours of time would be the cost savings and schedule time savings.

The SSL Light Subassembly 20 allows for the finished assembly of the SSL Fixture Assembly to be completed in the field. The mechanical and electrical assembly of the SSL lighting assembly sealed in a manner which provides the necessary durability to withstand the environments and field handling for field installation into the strut channel. Installation into the strut channel can be achieved through insertion through the open face of the strut channel or insertion into an open end of the strut channel and slid down the length into position. Features in the housing and optic surface provide a protective element to prevent lens damage during installation. The combined optic, LED electrical circuit and heat sink and system of sealing the assembly provides a lighting subassembly with an overall rigidity and strength required for handling and field installation. Insertion and removal trials were conducted with the SSL Light Subassemblies 20.

Early prototypes without the flat top surface, notched endcaps, flat housing back surface and semi-circular inset corners experienced repeated jamming of the retention spring plate and subassembly within the strut channel opening and pocket. SSL Light Subassembly 20 when inserted were found to be off-center resulting in modified light output patterns or undesirable aesthetic results. Retention spring plates placed in normal mounting orientation with the plate positioned at the face of the opening also resulted in jamming of the SSL Light Subassembly 20, retention spring plate and strut channel pocket during installation. Installation via this method resulted in greater than 70% jamming during installation. Use of a spring plate for retention with the plate positioned to align with the back surface of the SSL Light Subassembly 20 resulted in less than 20% jamming and jamming was less severe (i.e., more easily corrected).

Testing was conducted of the optical alignment system within the SSL Light Subassembly 20 assembled in a 1⅝" strut channel. The subassembly placed first at a position consistent with the endcaps with the removable tabs intact, still in place. The resulting light output angle imaged at an approximately 90-degree batwing pattern. Photo imaging of the test assembly shows the reflected surface light on the opening vertical walls. Optical ray tracing of the reflected light indicated that the majority of the light was being pushed back into the batwing pattern with a small percentage reflecting outside the 90-degree batwing pattern. Further enhancements of the optical alignment system and strut opening would optimize the reflected light pattern and increase the assembly coefficient of utilization placing more of the reflected light output into the appropriate area of the 90-degree batwing pattern. Similarly, addition of a baffled surface at the strut opening vertical surface would act to reduce glare and absorb or redirect the light back into the SSL Light Subassembly 20 to be redirected into the 90-degree batwing pattern, or again reflected back into the subassembly.

Repositioning of the optical alignment system, to a position consistent with the removal of the endcap removable tabs, resulted in a light output angle of approximately 120 degrees within a batwing pattern. Photo imaging of the test assembly showed a reduction of the reflected light on the strut opening vertical walls; these results were confirmed with photometric simulation and testing. Further refinement of the optical alignment system and strut opening would optimize the batwing pattern to adjust for LED-to-batwing lens position relative to strut opening features and position.

Placement of a secondary optical component into the optical alignment system, to produce a narrowing or asymmetric pattern to achieve a narrowing of the batwing pattern or an asymmetric wall washing effect were also conceived and tested. Further refinement of these approaches within the optical alignment system are required to optimize these patterns.

Light testing of the SSL Lighting Fixtures versus commonly available fixtures within an industrial space demonstrated performance gains in fixture coefficient of utilization, uniformity of light levels and corresponding enhanced energy efficiencies. Tests of a vapor fixture resulted in a 43% reduction in power consumption with a corresponding 16% increase in light output from the SSL Light Fixture. The corresponding improved fixture coefficient of utilization in a 10' room with 8' ceilings was greater than 30% improvement. Tests were performed to validate the effective assembly of an SSL Lighting Subassembly into common strut channel open continuous slot and open end, validating the ease of installation, standard and custom fastening methods, subassembly durability during assembly and subassembly alignment within the SSL Fixture and System. Tests were conducted to demonstrate physical durability testing and trials with the new and strut channel light fixture versus traditional light fixtures, demonstrating excellent results in durability and survivability when exposed to typical mechanical handling and impact.

A feature and advantage of embodiments is a method of installing an elongate light unit in an U-shaped channel with inwardly turned edges at the channel opening, the channel opening facing downwardly, the method comprising rotating the light unit so that a lateral edge of the light unit is confronting the channel opening, the thickness of the light unit being less that the width of the channel opening, inserting the light unit into an open interior of the channel the lateral edge first, rotating the light unit 90 degrees when the light unit is in the open interior of the channel whereby the horizontal width of the light unit is greater than the width of the channel opening, whereby the light unit is retained in the interior of the U-shaped channel.

Designs, descriptions and illustrations included in this disclosure come from the experimental work and are representative of certain embodiments of the present invention but are not limited to these embodiments.

DETAILED DESCRIPTION

Figure 1A:
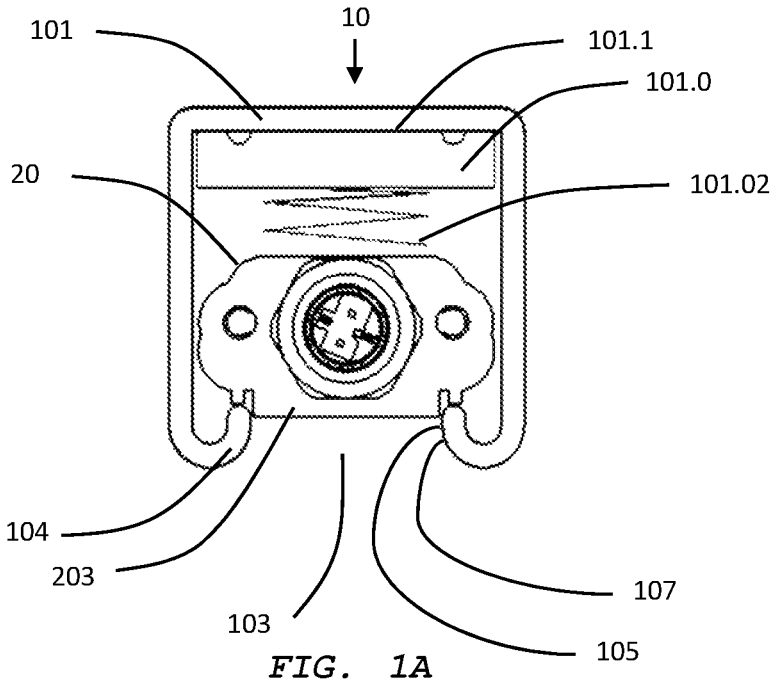
FIG. 1A End view of a structural (Strut) channel SSL Light Fixture Assembly with SSL Light Subassembly.

Referring to FIGS. 1A-4, SSL Light Fixture Assembly 10 comprises of one or more SSL Lighting Subassemblies or elongate insertable light unit 20, with an LED electrical circuit 201, housing 202, endcaps 203, lens 204.1 and optics 204.2 with a system for mounting, alignment and powering of the subassembly. The SSL Light Fixture Assembly 10 may be either stand alone or part of a larger ceiling grid system 30. The larger ceiling grid system 30 comprising a plurality of structural channels 101 suspended some distance from a ceiling 302 or support beam via mechanical hardware or cabling 304. The stand-alone SSL Light Fixture Assembly 10, either stand alone or integrated as part of the larger ceiling grid system 30, providing structural support for building system (MEP) 305 and other building system components.

The SSL Light Fixture Assembly 10, in embodiments includes an outer mechanical structure configured as a U-shaped channel 101 designed to provide an open interior 102 to contain the light unit 20 and a channel or light unit opening 103 for insertion and removal of the light unit 20 and for the light output. The U-shaped channel has an upper wall portion 101.9, and two J-shaped wall portions 101.11 with inwardly directed curved lip portions 104 that define a seat 101.16 for mounting and alignment of the SSL Light Subassembly 20 insertion and removal of the light unit 20 and for the U-shaped channel 101 for protection of the light unit 20. In addition, the channel 101, provides one half of the alignment mechanism 105, the full alignment system established when the strut channel 101 is combined with the light unit 20 forming an SSL Light Fixture Assembly 10. Referring to FIG. 1A, the light unit 20 may have a maximum width W1, the channel opening 103 having a width of W2, the light unit having a maximum height of H1. The height of the light unit allowing insertion of the light unit into the channel with a lateral side inserted first and the light unit rotated to seat on the channel seat 101.16. In that the width of the end cap are greater than the width of the channel opening as long as the light unit is not rotated with respect to the channel, it remains within the open interior 101.21.

In embodiments the maximum width of the light unit, which is at the end cap is 1.375 inches. The max height is 0.75 inches.

Figure 1B:
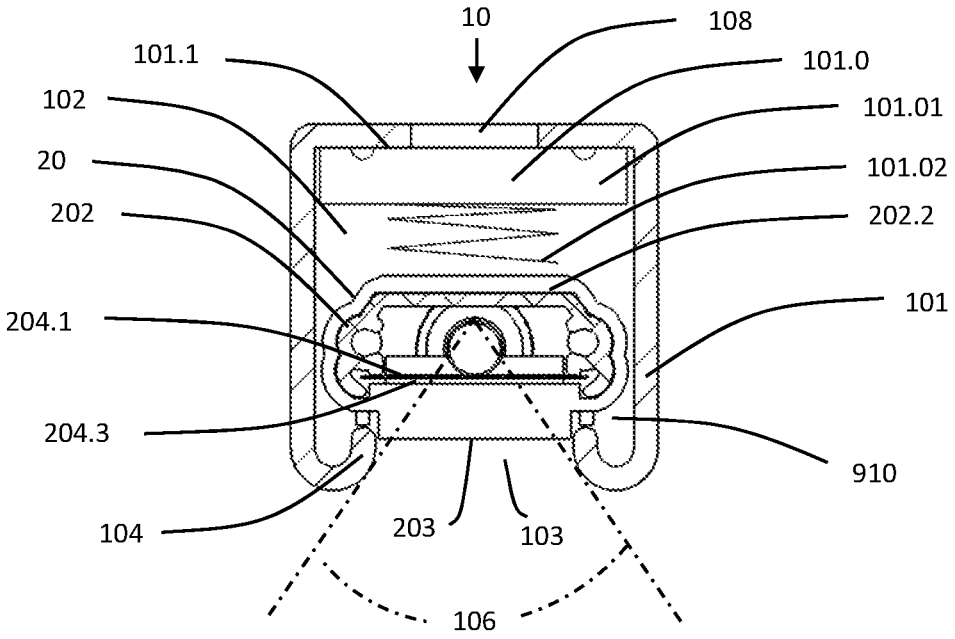
FIG. 1B Section view of SSL Light Assembly with installed SSL Light Subassembly.
Figure 2:
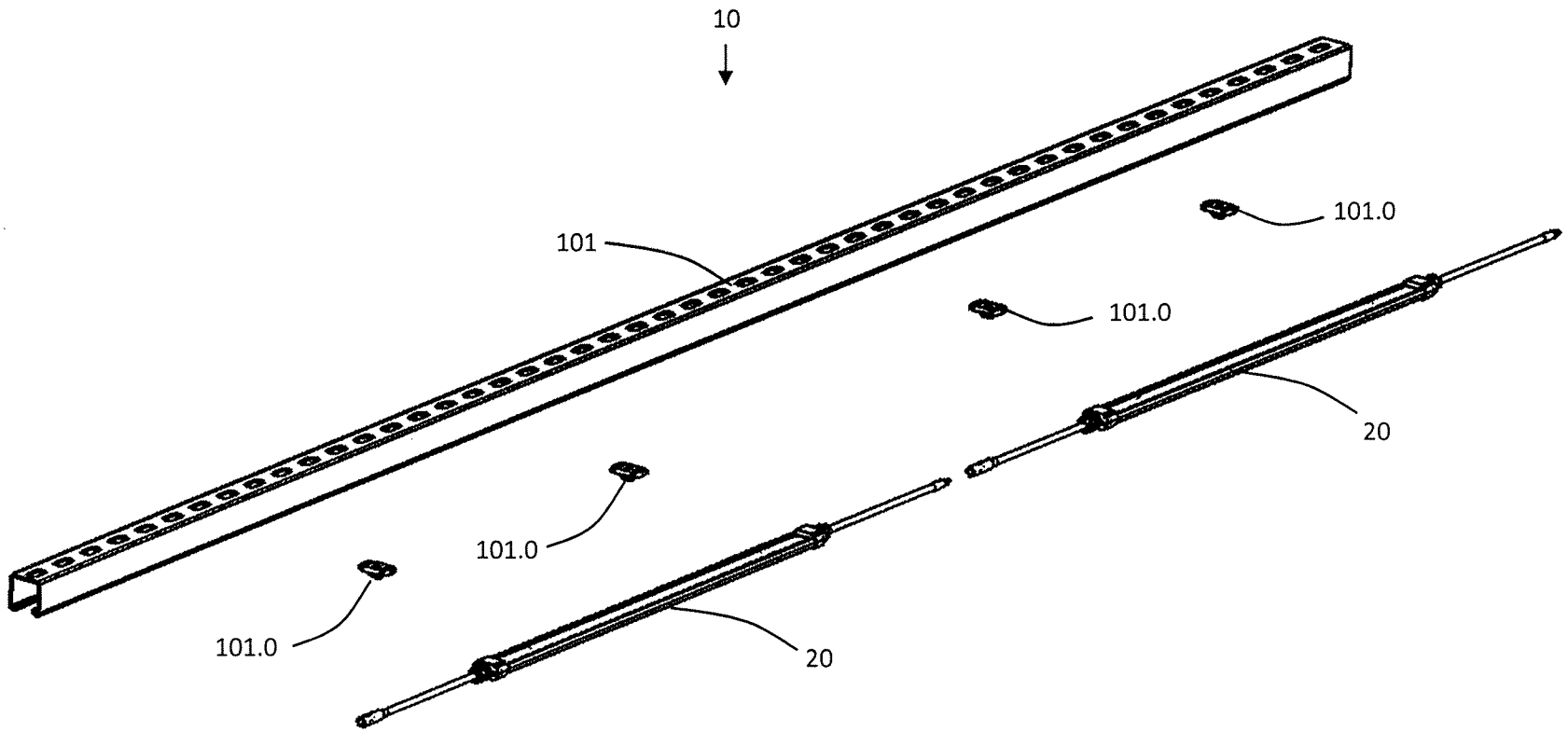
FIG. 2 Exploded isometric view of SSL Light Fixture Assembly and SSL Light Subassembly.

The strut channel opening 103 for light output pattern 106 providing an optic control surface 107 to work in combination with the light unit 20 optics system for redirecting of the subassembly light output pattern 106, FIGS. 1A & 1B. The strut channel structure, the U-shaped channel 101, FIGS. 1A-1B, 2 & 3 further providing the mechanical integrity for structural ceiling grid system 30 supporting installation of building system Mechanical, Electrical and Plumbing components 305. The strut channel structure 101 FIG. 3 including features to provide for the necessary mounting connection and routing of the system electrical power connection and power supply such as fittings, electrical boxes 403 and other similar components.

Figure 15A:
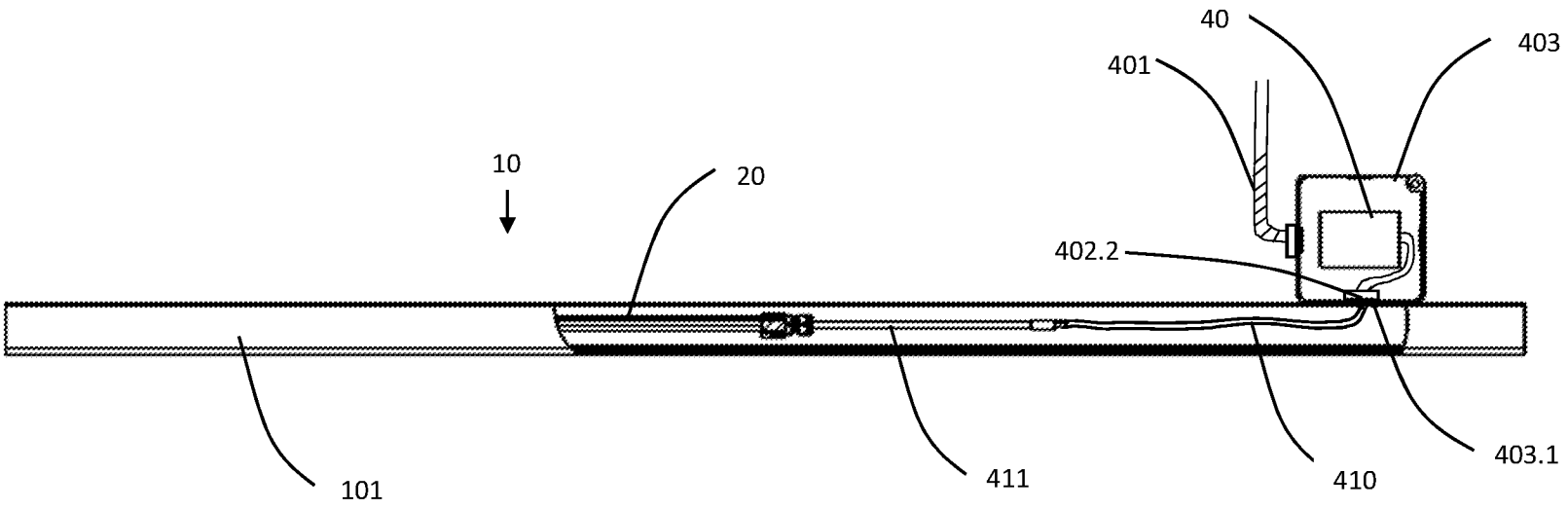
FIG. 15A Subassembly wiring system and method for remote driver in a fixed standard J-Box installation with fittings.
Figure 15B:
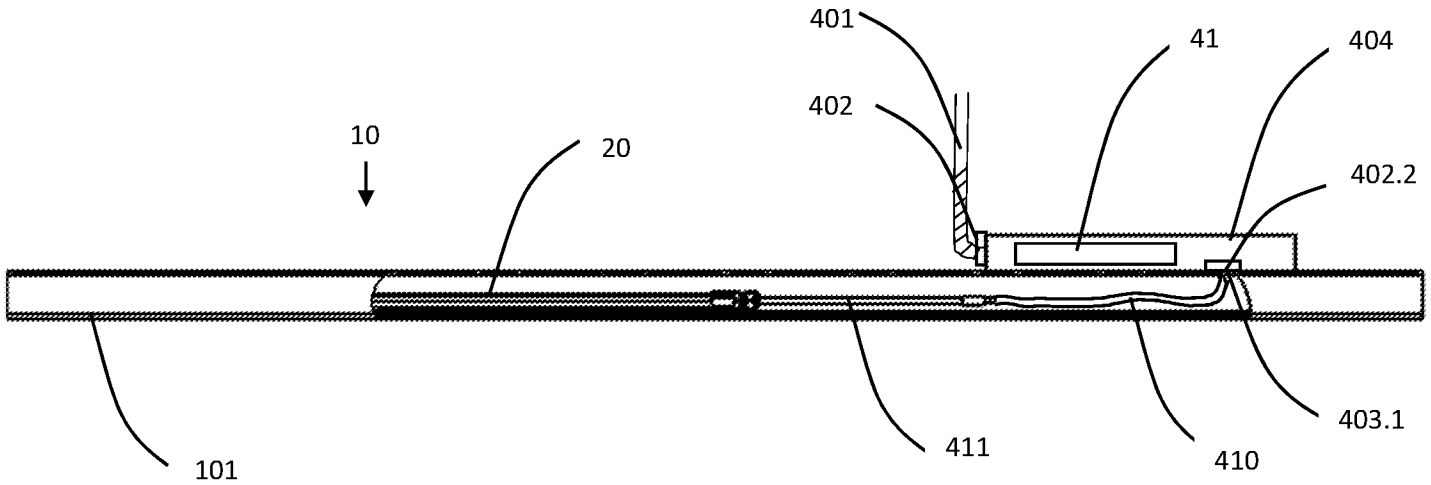
FIG. 15B Subassembly wiring system and method for remote longitudinal footprint LED driver in a strut channel raceway with fittings.
Figure 15C:
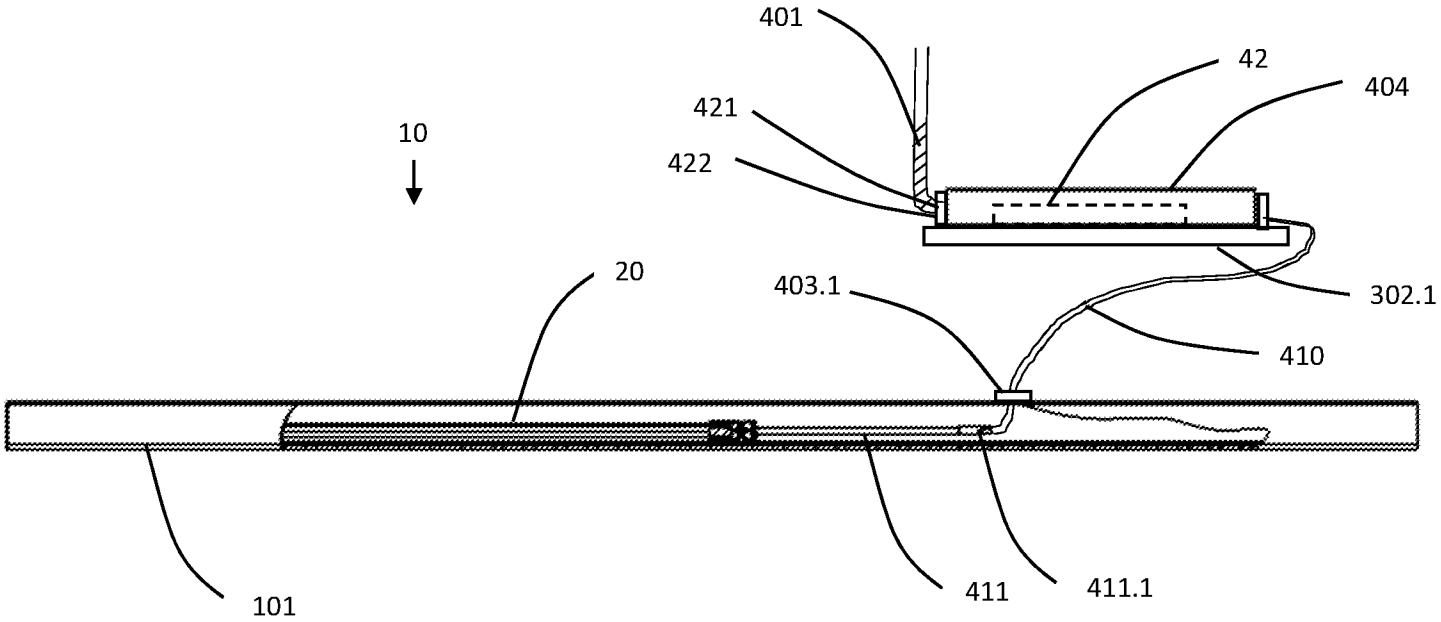
FIG. 15C Subassembly wiring system and method of installation for remote LED driver with wire harness and strut channel fitting.
Figure 16:
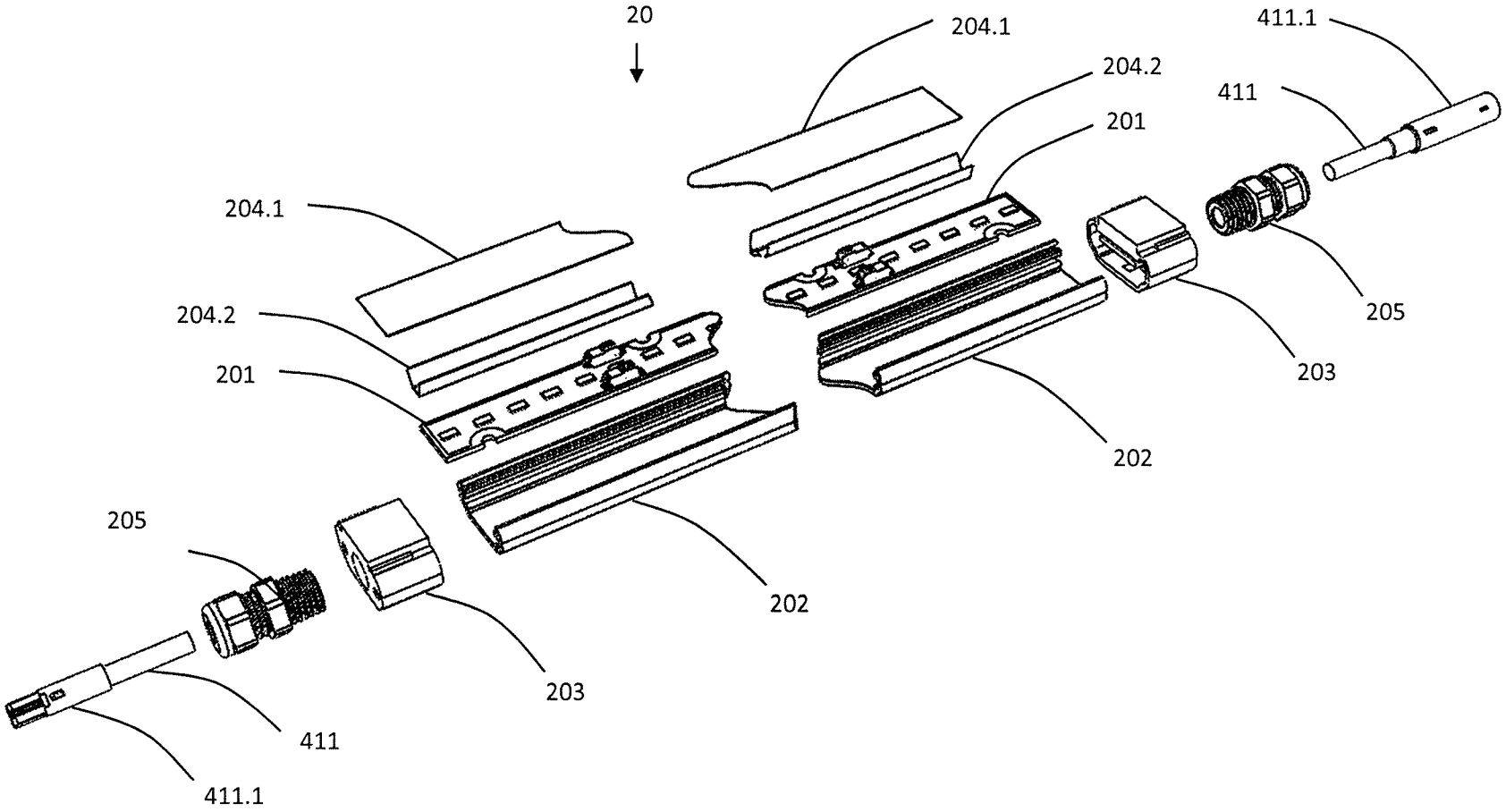
FIG. 16 SSL Light Subassembly—Exploded View Assembly Drawing.
Figure 17:
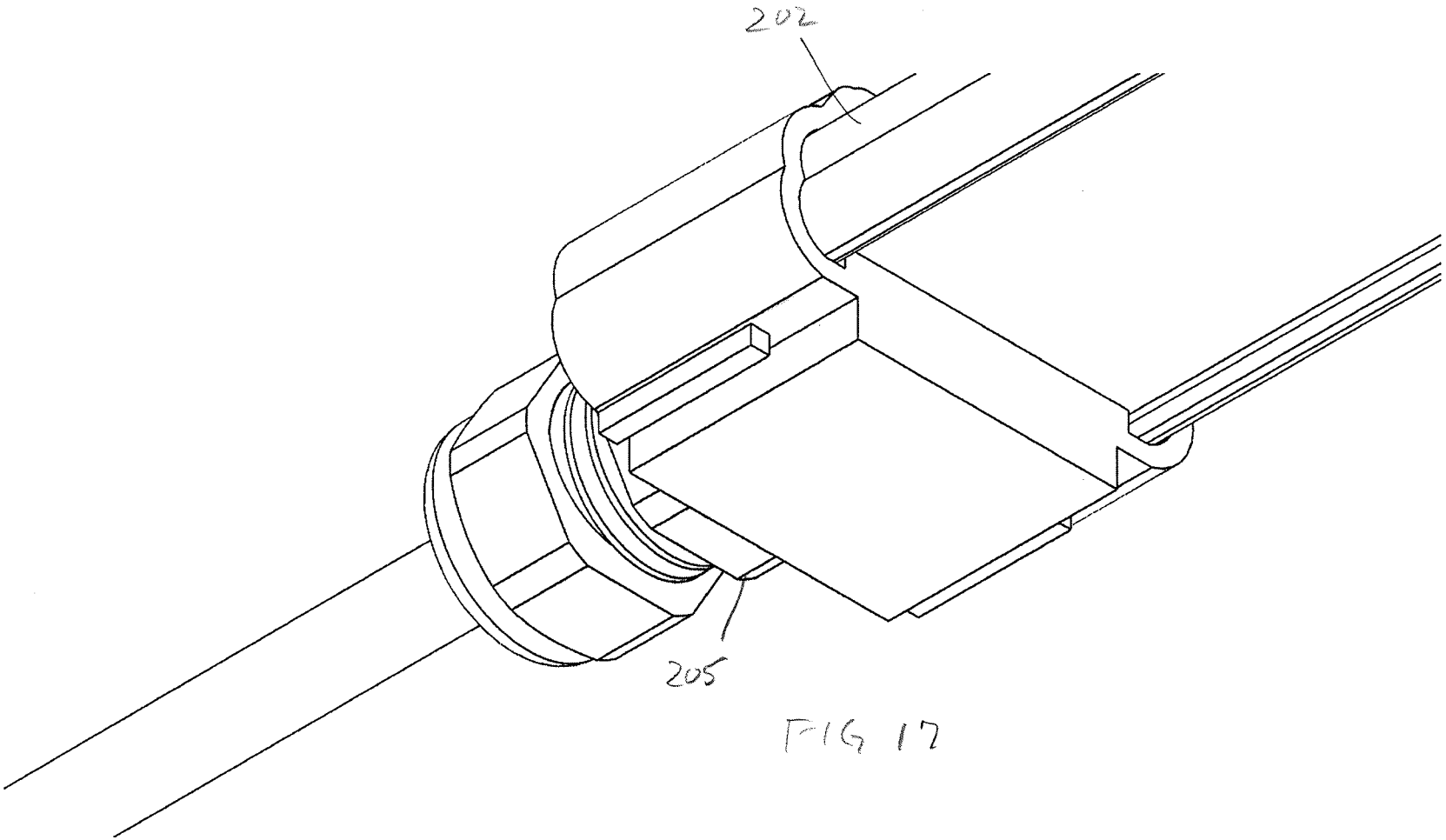
FIG. 17 Is a detailed perspective view of a connection to a light unit.
Figure 18:
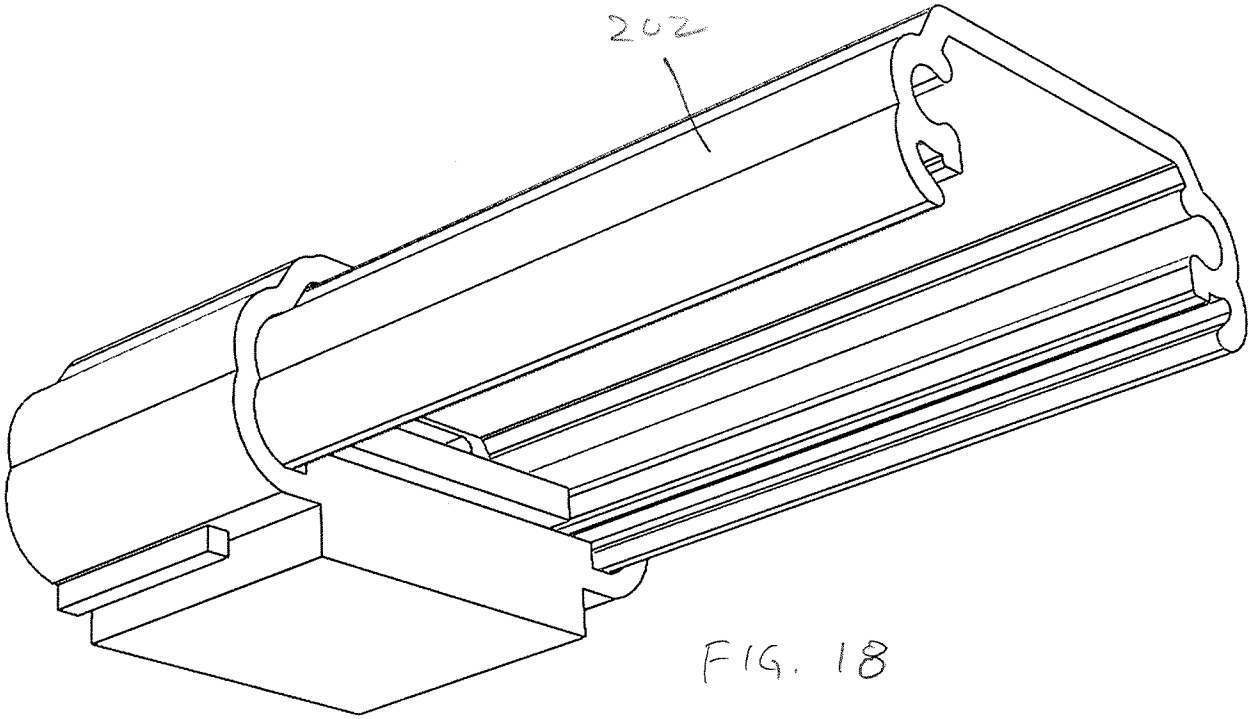
FIG. 18 Is a detailed perspective view of a connection between the housing an end cap.
Figure 19:
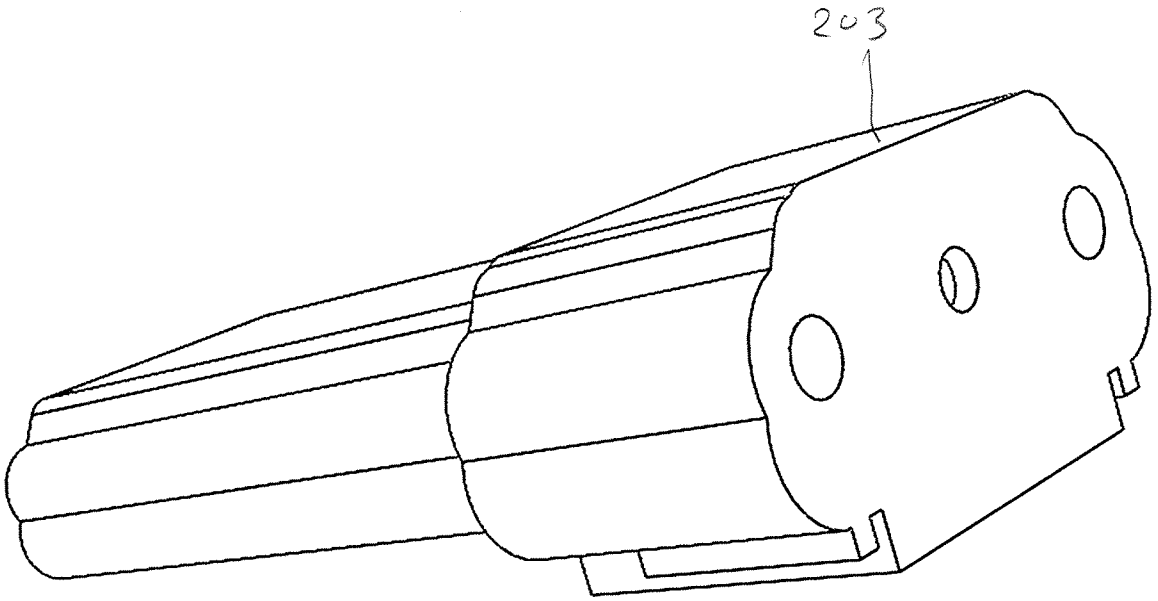
FIG. 19 Is the connection of FIG. 18 from an opposite view.
Figure 20:
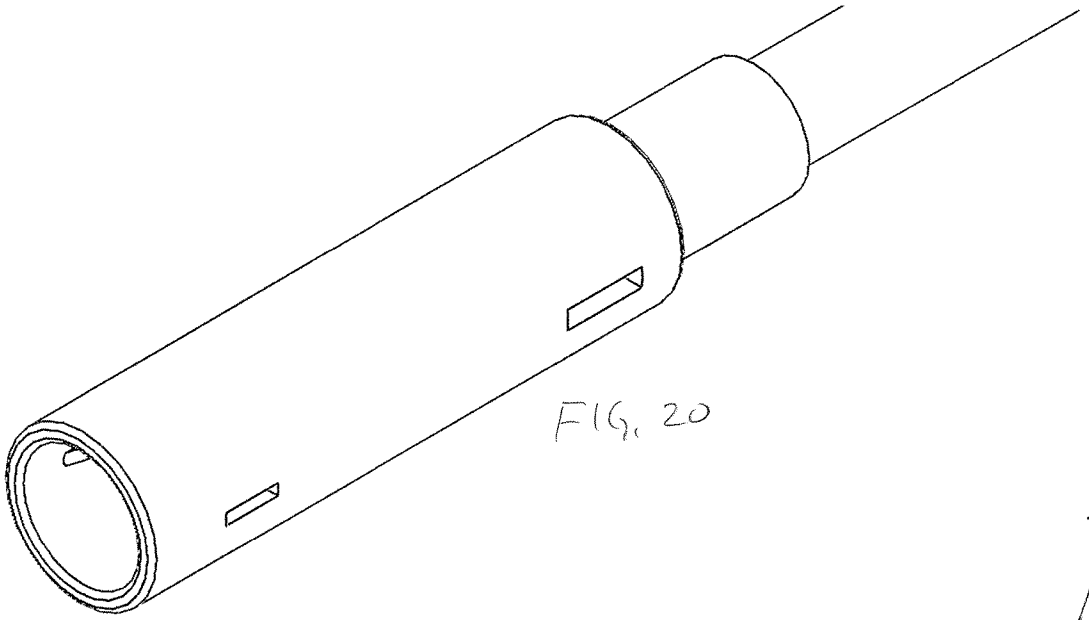
FIGS. 20-23 Are perspective views of quick connect plugs and receptacles.
Figure 21:
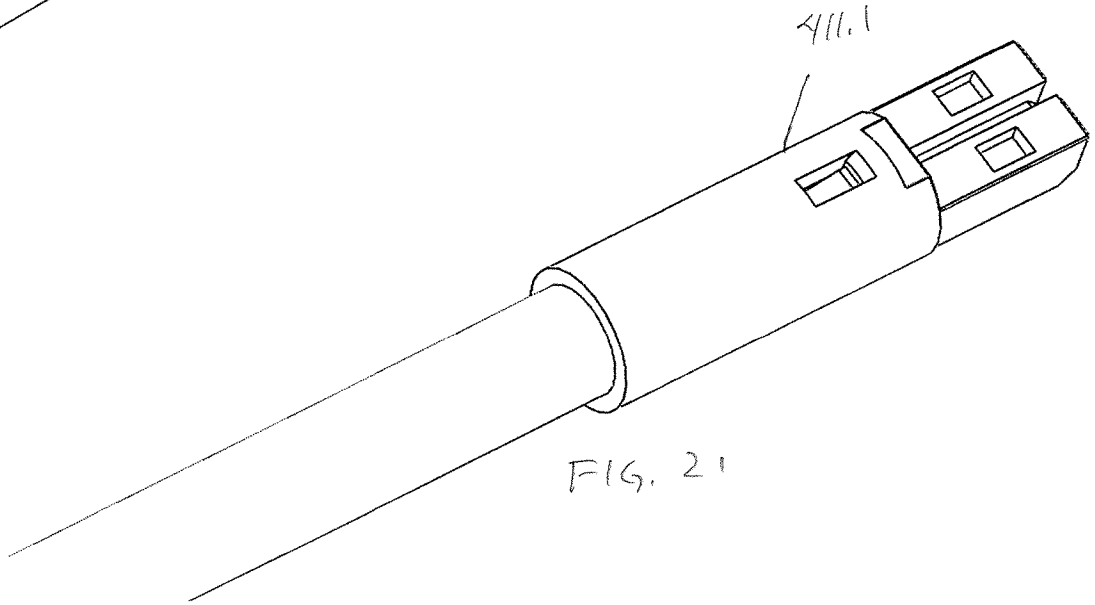
Figures 22, 23:
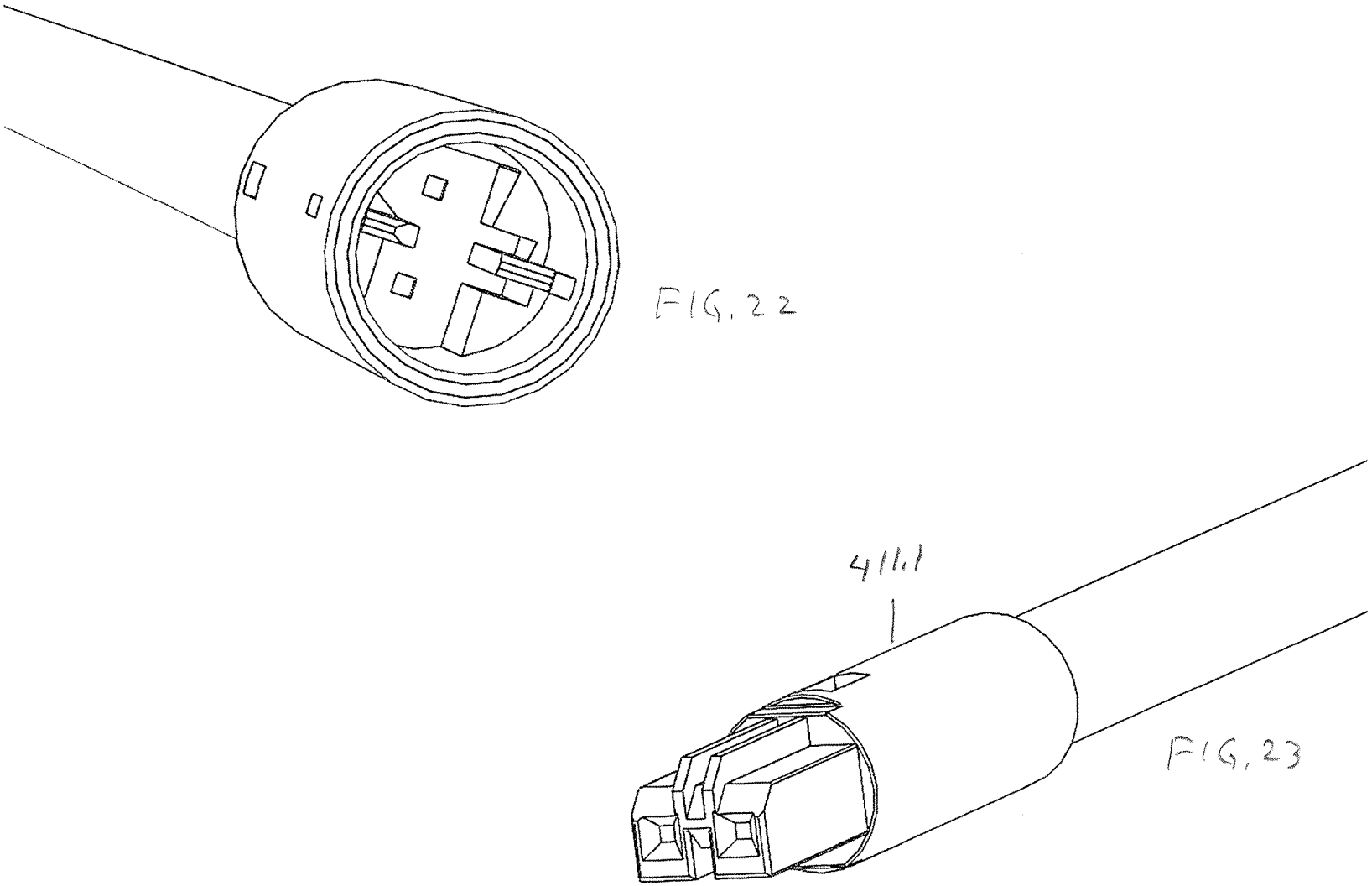
Figure 26:
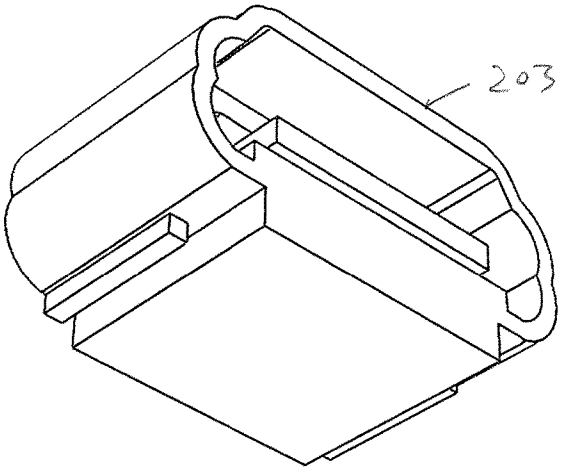
FIGS. 24-26 Are perspective views of an end unit.
Figure 24:
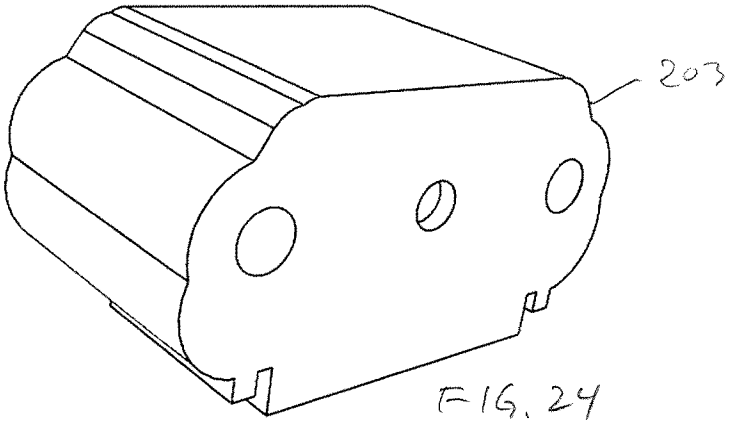
Figure 25:
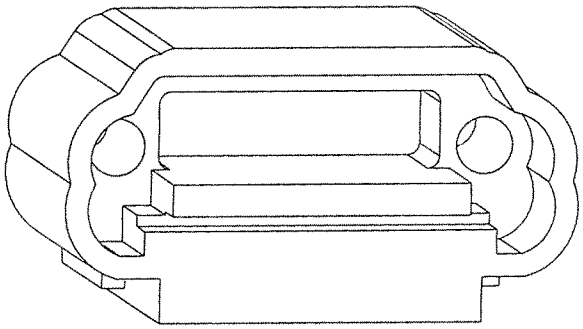

The SSL Fixture Assembly 10, FIG. 15A including one or more SSL Light Subassemblies 20 with a remote LED driver 40 positioned within a NEC approved standard J-Box 403 and flex conduit 401 power supply to the J-box 403. The SSL Light Subassembly 20, FIGS. 15A & 16 connected to the low power output of the remote LED driver 40 via a Class II wiring harness 411 with quick disconnect plug assembly 410 connected to a wiring harness 411 with quick connect receptacle 411.1 coming from the LED driver 40 and routed through the strut channel 101 through a common strut channel electrical fitting 403.1. The SSL Fixture Assembly 10, FIG. 15B including one or more SSL Light Subassemblies 20, FIGS. 15A & 16 with a remote longitudinal LED driver 41 mounted on a strut channel raceway enclosure 404 fitted with end fittings and wired via flex conduit 401 power supply to electrical knockouts 402.2 in the end fittings. The SSL Light Subassemblies 20 connected to the low power output of the remote Class II longitudinal LED Driver 41 via a Class II wiring harness 410 with quick connect plug assembly 411 connected to a wiring harness with quick connect receptacle 411.1 coming from the LED driver 42 and routed through the internal or external fittings 403.1 and or knockout 402 in the strut channel raceway 101. The SSL Light Assembly 10, FIG. 15C including one or more SSL Light Subassemblies 20 with a remote self-contained LED driver 42 mounted on a structural beam 302.1 or other adjacent open ceiling structure 302, FIG. 3. The SSL Light Subassemblies 20 connected to the low power output of the remote Class II self-contained LED driver 42 and enclosure 404 and wired via flex conduit 401 power supply to knockouts 422 in the line voltage supply J-box 421 of the self-contained LED driver 42. The SSL Light Subassemblies 20 connected to the low power output of the remote Class II self-contained LED driver 42 via a Class II wiring harness 411 with quick connect plug assembly 411.1 connected to a wiring harness with quick connect receptacle 410 coming from the self-contained LED driver low voltage J-Box and routed through the open ceiling structure through the top of the strut channel 101 via a fitting 403.1 in an opening in the top of the strut channel 101.

Figure 10:
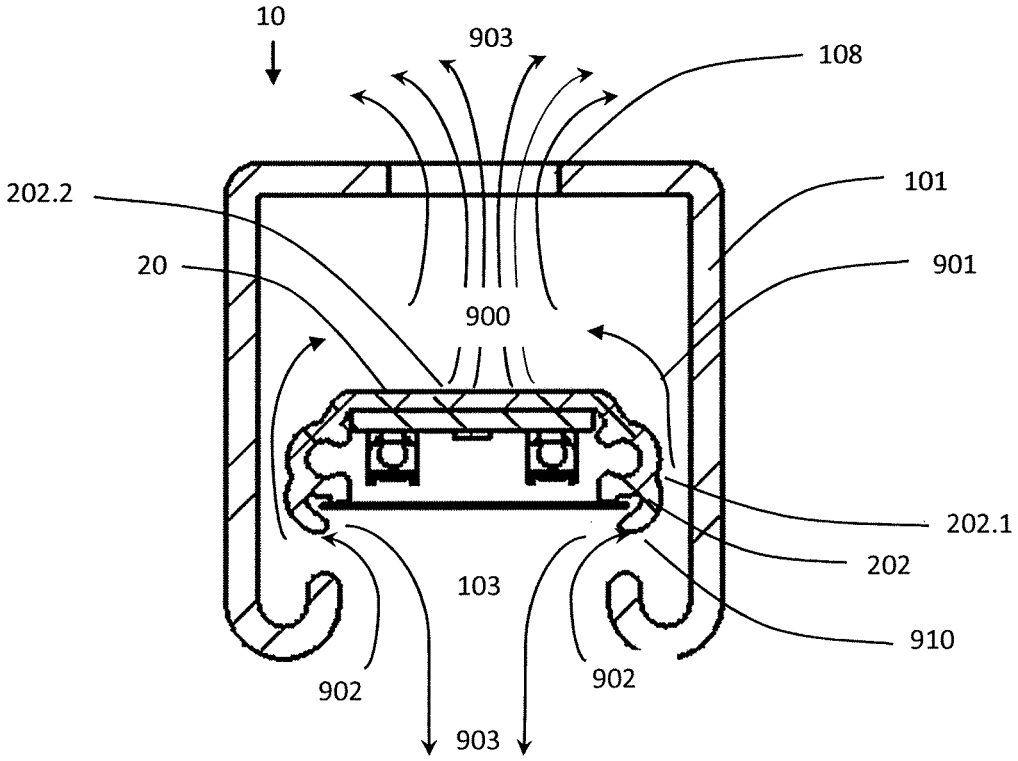
FIG. 10 SSL Light Subassembly—Cross Section with Extrusion Housing Detail—Side and Top Thermal Convection Features.

The strut channel 101 structure FIG. 1A is typically constructed of steel but may be made from various materials including but not limited to aluminum, fiberglass, carbon graphite, polyvinyl chloride (PVC), and other structural materials. The SSL Light Subassembly 20 designed with an endcap 203 with a removable alignment tab 203.3, FIG. 7 and an alignment notch 203.4 and when inserted into a strut channel 101, FIG. 1B opening 102 in direct contact with strut channel 101 vertical surface 104 as to produce a gap 910 between housing 202 and strut channel 101 vertical support structure 104, FIGS. 1B & 7. The SSL Light Subassembly 20, FIG. 7 having a housing 202 constructed of thermally conductive material such as aluminum and at least one SSL Electrical Circuit 201 mounted to the housing 202 in such a manner as to provide for good thermal conduction between the SSL Electrical Circuit 201 and the housing 202. The housing 202 having a top surface 202.2 and side vertical surfaces 202.1 with enough surface area as to provide sufficient thermal dissipation 900, 901 & 903, FIG. 10 as to maintain LED 201.1 Tc temperatures to achieve L70 50 k hour reliability performance regardless of the heat dissipation properties of the common strut channel 101. In embodiments, thermal dissipation of the SSL Light Subassembly 20 further enhanced through the mounting positioning of the SSL Light Subassembly 20, FIG. 10 positioned above the strut channel opening 103 in such a manner as to leave a gap 910 between the housing 202 and the strut channel 101. The opening 103 and gap 910 allowing free air flow 902 to enter the opening 103 and pass over the housing sides 202.1 and housing top 202.2 heat convective surfaces providing a path for heat dissipation 900, 901 & 903 to exit the SSL Light Assembly 10 through slot 108, FIG. 10. In one embodiment, a conductive path from the SSL Light Subassembly 20 to the strut channel 101 can be further conceived using direct contact with an inside surface of the strut channel 101, custom mounting brackets or available gap fillers as an alternate method of construction. These approaches are generally less desirable due to tradeoffs in construction, installation and thermal conduction to poor conductive strut materials.

Figure 3:
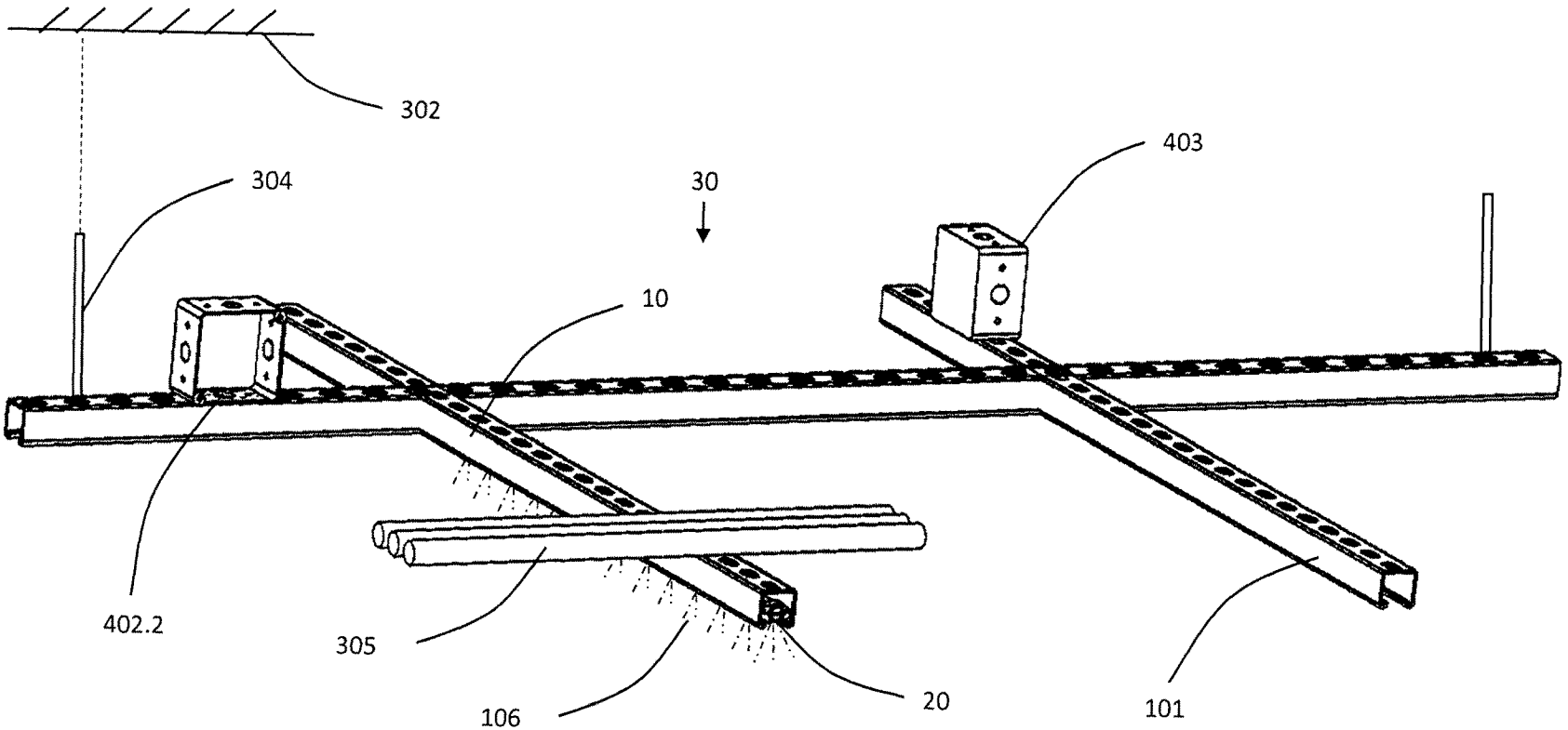
FIG. 3 Isometric view of installed strut channel grid system with SSL Light Assembly and Mechanical, Electrical and Plumbing (MEP) components.

The strut channel structure 101 FIG. 3 including features to provide for the necessary mounting, connection and routing of the system electrical power connection and power supply such as fittings, electrical boxes 403 and other similar components. The strut channel 101, FIG. 1A further including features for assembly and alignment of common mounting hardware 101.0 for insertion, alignment and retention of the SSL Light Subassembly 20.

Figure 5A:
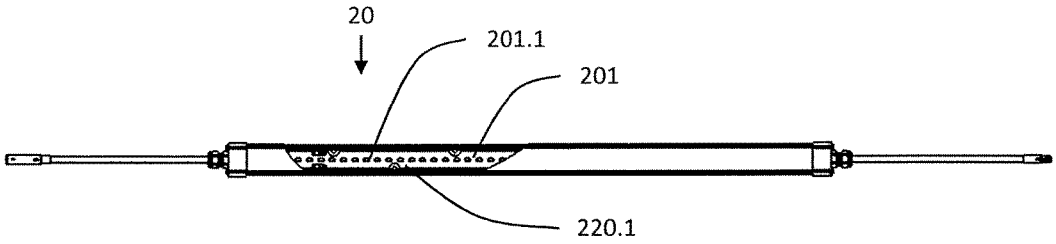
FIG. 5A SSL Light Subassembly with continuous SSL (LED) Circuit construction and light output.
Figure 5B:
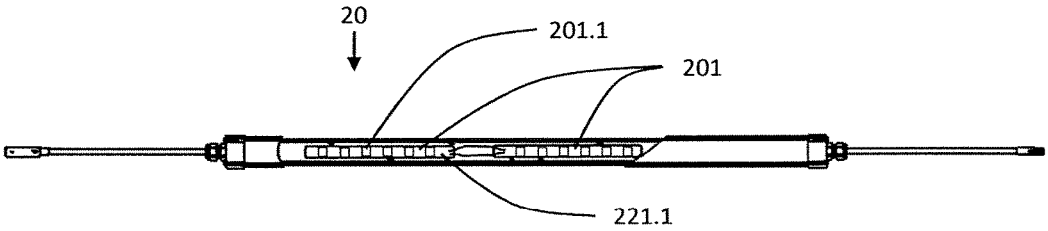
FIG. 5B SSL Light Subassembly with segmented SSL (LED) Circuit construction and continuous or segmented light output.
Figure 5C:
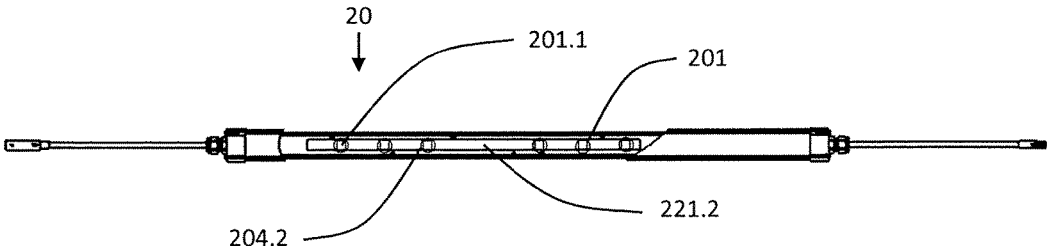
FIG. 5C SSL Light Subassembly with individual spot SSL (LED) Circuit construction and light output.

The SSL Light Subassembly 20, FIGS. 5A, 5B, & 5C constructed with LED circuits 201. In embodiments, the LED circuit 201 is constructed with at least one LED 201.1 creating a physically and electrically continuous LED circuit 220.1. In additional embodiments, SSL Subassembly 20, FIG. 5B illustrates of a polarity of LED circuits 201 each constructed with at least one LED 201.1 and electrically connected between LED circuits 201 creating an electrically continuous, physically segmented LED circuit 221.1 constructed within the SSL Light Subassembly 20. In another embodiment, SSL Subassembly 20, FIG. 5C illustrates of an LED circuit 201 constructed with individual spot LEDs 201.1 on a continuous circuit 221.2.

Figure 4:
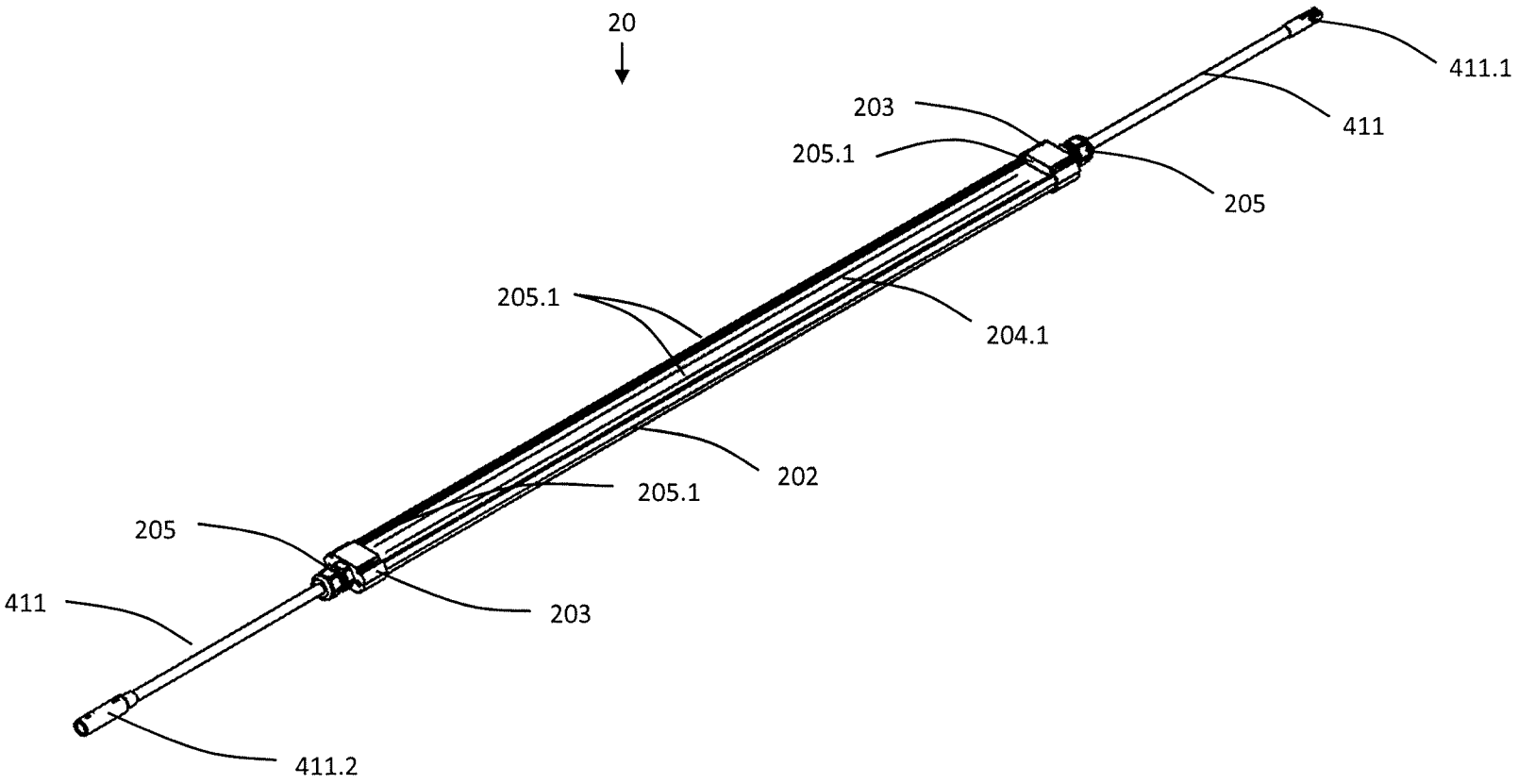
FIG. 4 Isometric view of SSL Light Subassembly.
Figure 7:
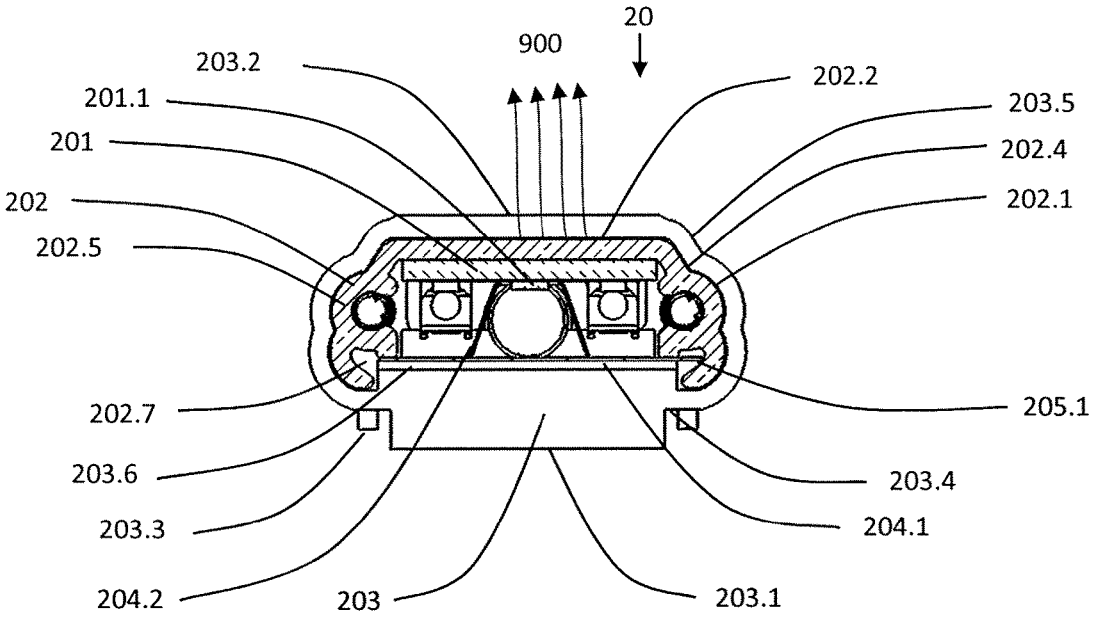
FIG. 7 SSL Light Subassembly—Detailed cross-section with features.

The SSL Lighting Subassembly 20, FIGS. 5C & 7 further includes optic system 204.2 for providing a variety of light output patterns specific for use in low or high ceiling applications typical in confined industrial spaces as well as general lighting for hallways, mechanical or electrical utility rooms, and other general lighting applications. The SSL Lighting Subassembly 20, FIGS. 1B, 4 &7 comprises of a protective lens 204.1 providing mechanical protection for the face of the electrical circuit 201, LEDs 201.1, and optics 204.2. The SSL Lighting Subassembly 20, FIGS. 1B & 4 further comprising of protective endcaps 203 providing protection for protective lens 204.1 face from damage from edges from the strut channel 101 mechanical structure. The SSL Light Subassembly 20, FIGS. 4 & 7 provide a seal 205.1 for a variety of ingress protection levels preventing ingress of dust and moisture. The SSL Light Subassembly 20, FIGS. 4 & 7 including a seal 205.1 along tangential edges of the lens 204.1 and housing 202 as well as a seal 205.1 at the Endcaps 203 at each distal end of the protective lens 204.1.

The SSL Lighting Subassembly 20, FIG. 7 in its embodiments is constructed of a linear housing 202 with a top flat surface 202.2 and vertical walls 202.1 extending vertically from the flat top surface 202.2. At the corners of the housing 202 where the flat top 202.2 and vertical walls 202.1 intersect, the vertical wall 202.1 is recessed and rounded as to provide a vertical step from the housing flat top 202.2 to the vertical wall surface 202.1. The recessed feature 202.4 in the housing 202 is set in from a line perpendicular to the flat housing top 202.2 and parallel to the vertical wall surface 202.1 and is semicircular in form. The recessed and semicircular feature 202.4 is duplicated in an offset feature 203.5 in the endcap 203 and is the embodiment allowing for installation clearance of the SSL Light Subassembly 20 within the strut channel 101, FIG. 1A as part of final assembly of SSL Light Fixture 10. The recessed and semicircular form 202.4 further providing a location internal to the housing 202 corners adjacent to the housing flat surface 202.2 for the formation of a uniform wall thickness semicircular feature 202.5 partially open to the inside of the housing and useful for Endcap attachment. The flat housing top surface 202.2, FIG. 7 maintains a precise flatness and parallelism to the endcap flat bottom surfaces 203.1 and alignment removable tab 203.3 and alignment notches 203.4 thus providing parallel alignment with the strut channel opening 103, FIG. 1B. The vertical walls 202.1, FIG. 7 are generally non-flat providing features running linearly along the vertical walls 202.1 for handling during assembly of the SSL Light Subassembly 20 into the strut channel 101 of the SSL Light Fixture 10, FIG. 1B. The vertical walls further including features for retention of various lens and optic components. Openings at the distal ends of the vertical walls 202.1 provide features for protection to lenses preventing damage to lenses and optics during installation into the SSL Light Fixture. The embodiment including a pocket 202.7, FIG. 7 running linearly along the vertical walls 202.1 of the housing 202 from distal end to distal end and providing the function of alignment of the lens 204.1 as well as containment of sealant 205.1 for sealing of the lens 204.1 or cover 204.3 to the housing vertical walls 2021.

Figure 8:
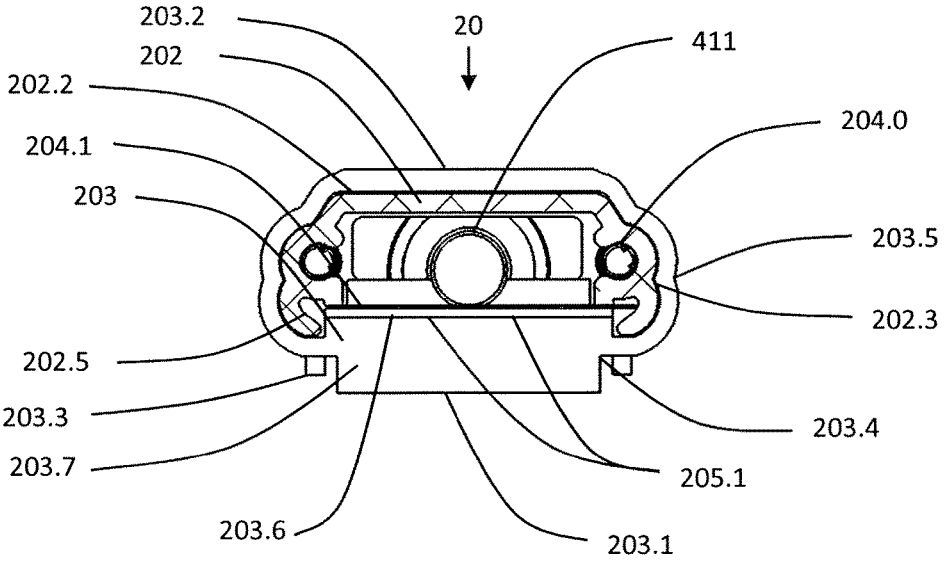
FIG. 8 SSL Light Subassembly—Cross Section with Endcap Detail (Alignment Notch, Removable Tab, Finger Grip features).
Figure 12A:
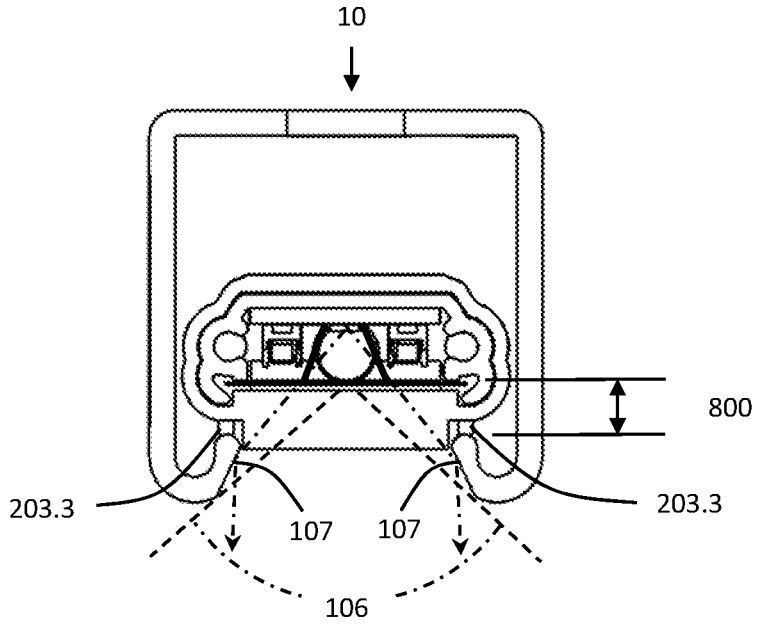
FIG. 12A Optical control surfaces use of structural channel opening to optimize light output pattern.
Figure 12B:
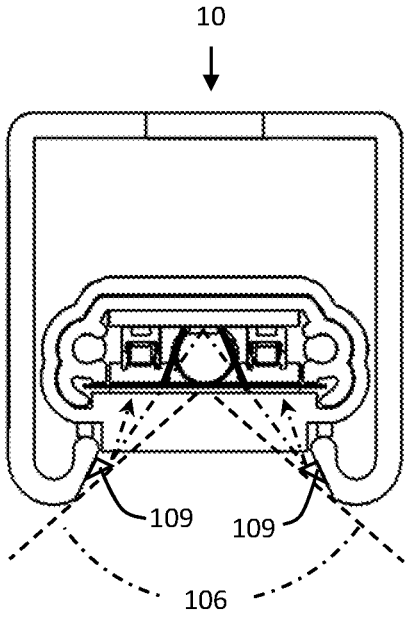
FIG. 12B Optical control surfaces at channel opening to optimize light output pattern.
Figure 13:
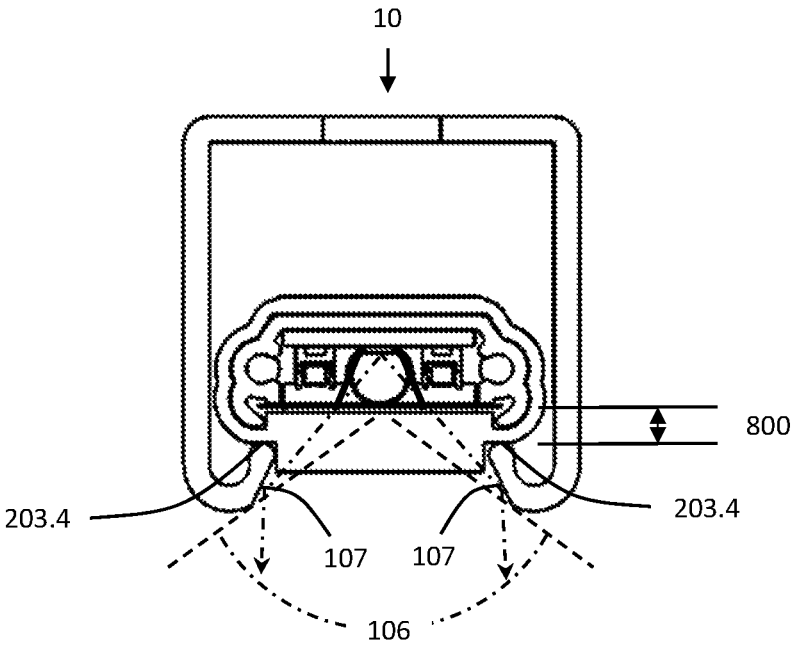
FIG. 13 Use of the optical alignment system to optimize the light output angle.
Figure 14:
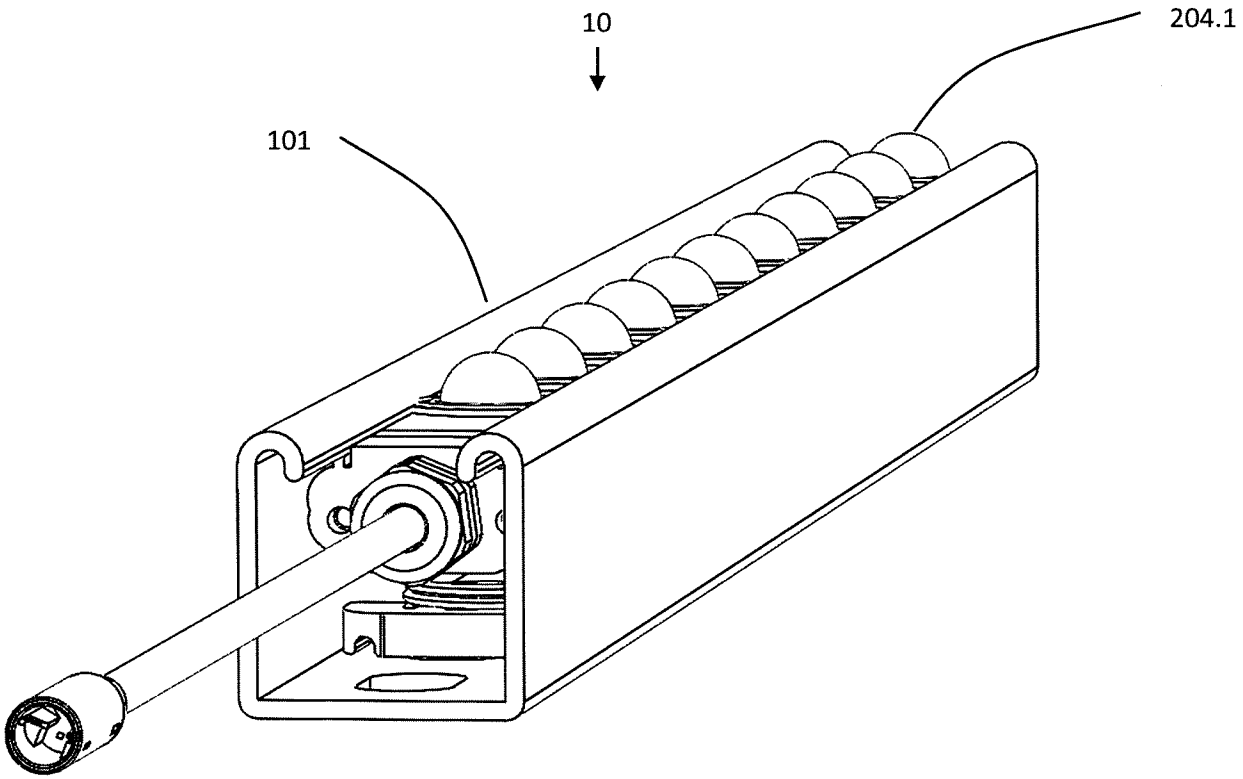
FIG. 14 Light subassembly extended beyond strut channel structure.

The SSL Lighting Subassembly 20, FIGS. 4, 7 & 8 utilizes an Endcap 203 positioned at each distal end. The Endcap 203 providing features for optical alignment, subassembly installation, sealing of the housing end from moisture and dust and protection from mechanical damage during installation. The Endcap 203 in its embodiment having a flat top 203.2 aligned parallel with the housing flat top 202.2 and positioned slightly above the position of the housing flat top 202.2 as to allow no portion of the housing flat top 202.2 to extend beyond the Endcap flat top 203.2. The Endcap 203, FIGS. 1A, 7 & 8 further having non-flat vertical sides 203.5 providing finger grip locations along the outer surfaces for holding of the SSL Light Subassembly 20 during installation into the strut channel 101 of the SSL Light Fixture 10. The Endcaps 203, FIG. 8 having a horizontal shelf 203.6 extending beyond the inside vertical face 203.7 of the endcap 203 and precisely parallel to the desired position for the lens 204.1 in the housing 202. The gap above the horizontal shelf 203.6 being the width of the lens 204.1 and/or cover 204.3 plus the additional necessary gap for the adhesive and sealant used to create the seal 205.1. The horizontal shelf 203.6 aligned with the vertical wall linear internal features for lens 204.1 and/or cover 204.3 installation, thus providing a feature for sealing the lens 204.1 to the Endcap 203 and housing 202. The endcaps 203, FIG. 8 having a bottom flat face 203.1 which is precisely parallel to the plane created in the housing flat top 202.2 and which extends beyond the housing vertical wall ends 202.3, lens 204.1 and/or cover 204.3 linear features. The endcaps bottom flat 203.1 FIG. 8, in combination with the endcap alignment tabs 203.3 and alignment notch 203.4 at each distal end, in this embodiment, providing the parallel alignment for the full SSL Light Subassembly 20 mounted within the strut channel 101, FIG. 1B providing a consistent and repeatable linear alignment system for the SSL Light Subassemblies 20 to the strut channel 101 longitudinal opening 103. The endcaps 203, FIG. 7 further having alignment notches 203.4 on the bottom outside corners sized such as to align the geometric centerline of the SSL electrical circuit 201 with the geometric centerline of the structural channel opening 103. The endcap alignment notches 203.4, FIG. 8 in certain embodiments of the present invention further containing removable tabs 203.3 sized to adjust the height of the SSL Light Subassembly 20 within the common structural channel opening 103. The resulting change in height and relative position between the SSL Light Subassembly 20 and structural channel opening 103 resulting in a change to the optical light output 106 pattern from a medium 106, FIG. 12A to wide angle 106, FIG. 13. In the embodiments, the angle of the optical light output pattern 106 may be approximately 90 degrees to approximately 120 degrees.

Figure 9:
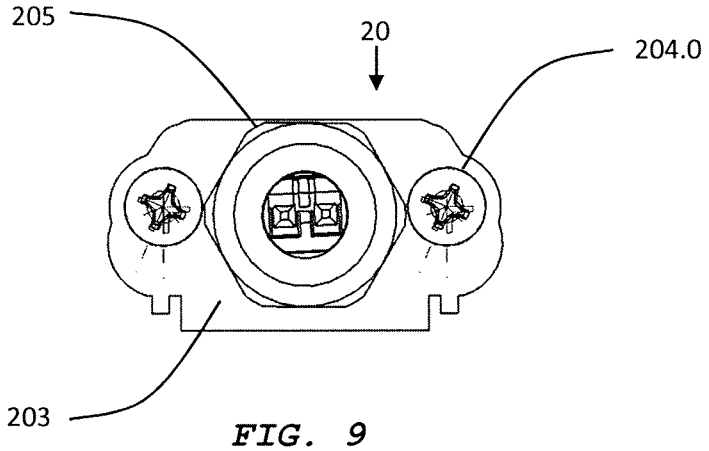
FIG. 9 SSL Light Subassembly—Cross Section with Extrusion Housing Detail (Finger Grip, Lens Seal, Board Center, Semi-Circular Lens Alignment and Seal features).

Referring to FIGS. 7-9, in embodiments, the Endcaps 203 are fastened to the SSL Light Subassembly 20 via mechanical fasteners such as screws 204.0 extending into apertures in the distal face of the endcaps 203 and extending through the respective wall and into lobes or features 202.5 within the housing vertical walls 202.1 of the housing 202. The Endcaps 203 further providing an opening for a wiring cable 411 and associated strain relief 205 component FIGS. 4 & 9. The wiring cable 411, FIG. 4 extended beyond the SSL Light Subassembly 20 and terminated with a luminaire electrical quick connector 411.1, 411.2. On one distal end of the SSL Light Subassembly 20, FIG. 4 the wiring cable 411 is terminated with an electrical quick connect plug 411.1 or receptacle 411.2. On the opposite distal end of the SSL Light Subassembly 20, the wiring cable 411 is terminated with the mating electrical quick connector (either receptacle 411.2 or plug 4111) or terminated with a plug.

Figure 6A:
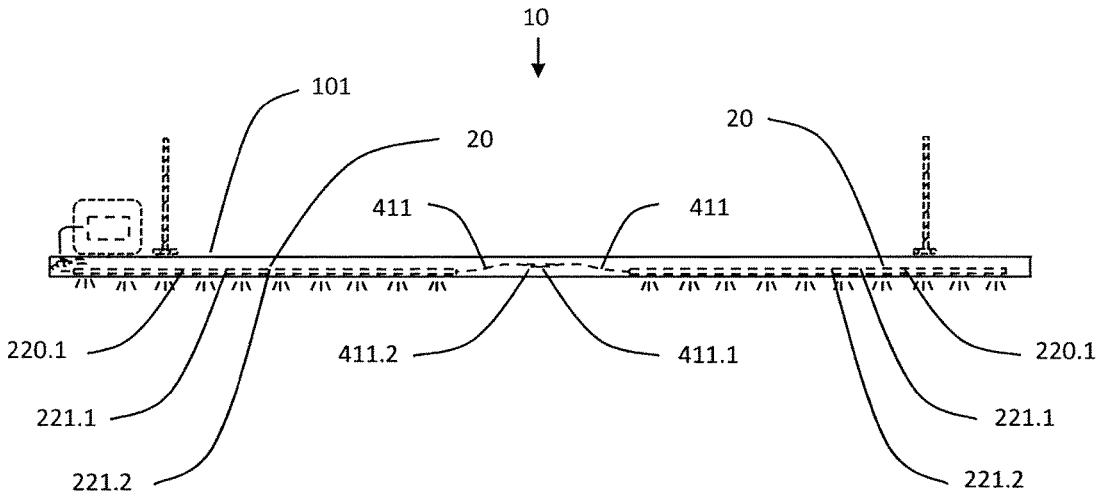
FIG. 6A SSL Light Assembly with segmented SSL Light Subassembly installation and light output.
Figure 6B:
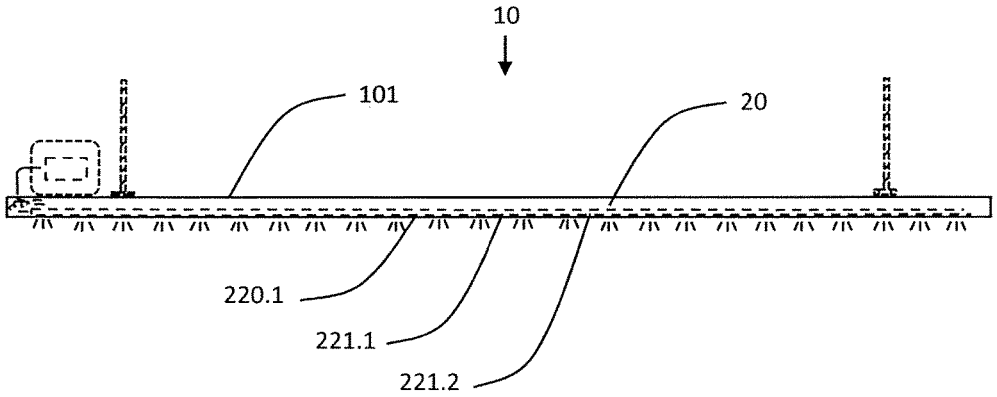
FIG. 6B SSL Light Assembly with continuous SSL Light Subassembly installation and light output.

The SSL Light Subassemblies 20 can be connected end-to-end within the SSL Light Fixture 10, FIG. 6A in succession thus extending the overall lighted length of the fixture. The SSL Light Subassemblies 20, FIG. 6A connected end-to-end with the wire cable 411 extending from the distal end of a first SSL Light Subassembly 20 and terminated with a wire quick connect receptacle 411.2 connected to a wire cable 411 extending from one distal end of a second SSL Light Subassembly 20 and terminated with a wire quick connect plug 411.1. The SSL Light Subassemblies 20 comprising of a continuous SSL (LED) circuit 220.1. In another embodiment, the SSL Light Subassemblies 20 comprising of a segmented SSL (LED) circuit 221.1, FIG. 6A. In another embodiment, the SSL Light Subassemblies 20 comprising of an individually spot (LED) circuit 221.2, FIG. 6A. In a certain embodiment of the invention, the SSL Light Subassemblies 20 are spaced along the SSL light fixture 10 and strut channel 101 thus allowing for flexibility in the placement of the light within a space FIG. 6A. A continuous linear SSL Light Subassembly 20 can also be envisioned for applications where maximum light output or visual aesthetics dictate such a solution FIG. 6B. The SSL Light Subassemblies 20 can be continuous within the SSL Light Fixture 10, FIG. 6B thus providing continuous light over the lighted length of the fixture. The SSL Light Subassembly 20, FIG. 6B illustrating of a continuous SSL (LED) circuit 220.1 within the strut channel 101. In another embodiment, the SSL Light Subassembly 20, FIG. 6B illustrating of a segmented SSL (LED) circuit 221.1 within the strut channel 101. In another embodiment, the SSL Light Subassembly 20, FIG. 6B illustrating of an individually spot (LED) circuit 221.2 within the strut channel 101. In certain embodiments the SSL Light Fixture 10 comprising of a combined emitter configuration with individual optics 204.2, FIG. 5C to produce a multiplicity of individual Spot SSL Light Subassemblies 20, FIGS. 6A & 6B for light output and alignment with slot openings 108, FIG. 1B in the common strut channel 101.

Figure 11A:
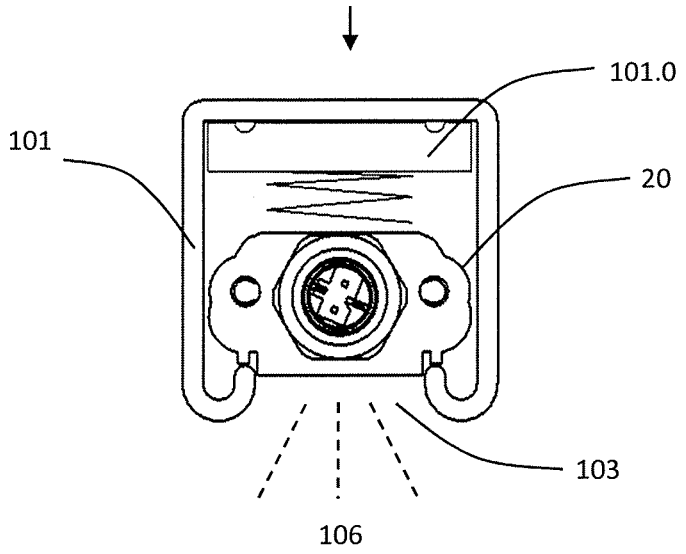
FIG. 11A SSL Light Assembly—Section View Down Lighting Thru Continuous Opening.

The SSL Light Subassembly 20, FIGS. 4 & 7 having sufficient mechanical structure between the housing 202, electrical LED circuit 201, endcaps 203, seal 205.1 and optics structure 204.1 to allow retention of the SSL Light Subassembly 20 within the strut channel structure 101. The SSL Light Fixture Subassembly 20 mechanically retained in the strut channel 101 utilizing traditional strut channel fasteners 101.0, FIG. 2, including but not limited to one or more spring loaded fasteners 101.0 with a flat plate 101.01, FIG. 1B positioned against the internal flat housing surface 101.1 with the spring compressed and pressed against the SSL Light Subassembly 20 housing top flat surface 202.2, without damaging the SSL Light Subassembly 20 or rendering the subassembly dysfunctional. The SSL Light Subassembly 20, FIG. 4 further having endcaps 203 at each distal end of the longitudinal housing 202. The endcaps 203 having a width greater than the opening 103 in the face of the strut channel 101, FIG. 1A as to allow the upward J shaped support structure 104 and gravity to retain the SSL Light Subassembly 20 within the Strut Channel 101. The SSL Light Subassembly 20 being retained in a downward facing orientation FIG. 11A such that the subassembly light output 106 exits the strut channel 101 opening 103 vertically downward and angled outward. The light output 106 of the SSL Light Fixture 10 being determined as a function of the light output angle 106 as achieved by the combination of the LED 201.1, FIG. 7, the secondary optic 204.2, the optic lens 204.1 and the optic control surfaces 107, FIGS. 12A & 13 or 109, FIG. 12B and the variable optic Y position 800. The variable optic Y position 800 being determined by the upward J shaped support structure 104 and the existence of the removable alignment tab 203.3 or in the case of the removal of the alignment tab 203.3, FIG. 13, the position of the alignment notch 203.4.

Figure 11B:
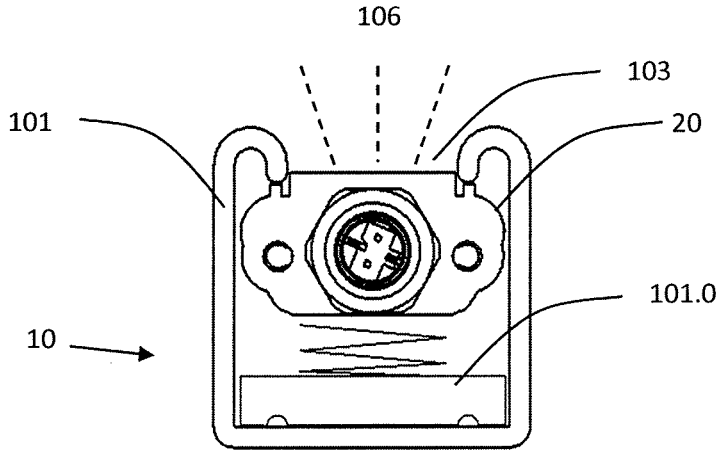
FIG. 11B SSL Light Assembly—Section View Up Lighting Thru Continuous Opening.

In other embodiments, the SSL Light Subassembly 20, FIGS. 4 & 7 having sufficient mechanical structure between the housing 202, electrical LED circuit 201, endcaps 203, sealing structure 205.1 and optics structure 204.1 to allow retention of the SSL Light Subassembly 20 within the strut channel structure 101. The SSL Light Fixture Subassembly 20 mechanically retained in the strut channel 101 utilizing traditional strut channel fasteners 101.0, FIG. 2, including but not limited to one or more spring loaded fasteners 101.0 with a flat plate 101.01, FIG. 1B positioned against the internal flat housing surface 101.1 with the spring compressed and pressed against the SSL Light Subassembly 20 housing top flat surface 202.2, without damaging the SSL Light Subassembly 20 or rendering the subassembly dysfunctional. The SSL Light Subassembly 20, FIG. 4 further having endcaps 203 at each distal end of the longitudinal housing 202. The endcaps 203 having a width greater than the opening 103 in the face of the strut channel 101, FIG. 1B as to allow the upward J shaped support structure 104 and the pressure from the spring-loaded fastener 101.0 to retain the SSL Light Subassembly 20 within the Strut Channel 101. The SSL Light Subassembly 20 being retained in an upward facing orientation FIG. 11B such that the subassembly light output 106 exits the strut channel 101 opening 103 vertically upward and angled outward.

Figure 11C:
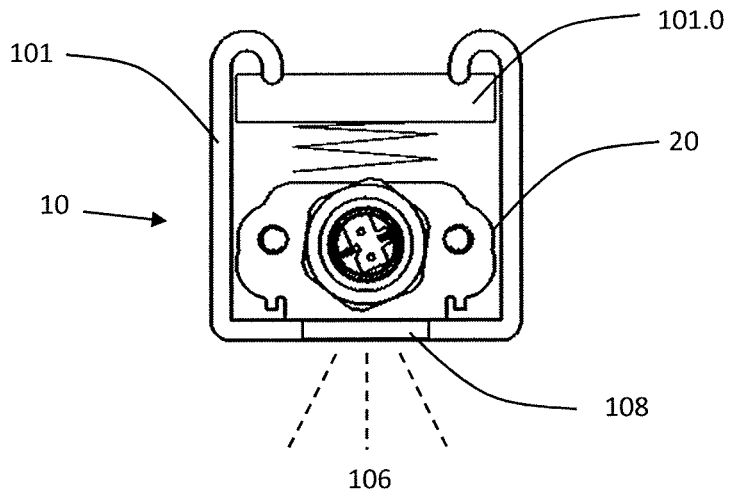
FIG. 11C SSL Light Assembly—Section View Down Lighting Thru Perforated Opening.

In other embodiments, the SSL Light Subassembly 20 FIGS. 4 & 7 having sufficient mechanical structure between the housing 202, electrical LED circuit 201, endcaps 203, sealing structure 205.1 and optics structure 204.1 to allow retention of the SSL Light Subassembly 20 within the strut channel structure 101. The SSL Light Fixture Subassembly 20 mechanically retained in the strut channel 101 utilizing traditional strut channel fasteners 101.0, FIG. 2, including but not limited to one or more spring loaded fasteners 101.0 with a flat plate 101.01, FIG. 1B positioned against the J shaped support structure 104 with the spring 101.02 compressed and pressed against the SSL Light Subassembly 20 housing top flat surface 202.2, without damaging the SSL Light Subassembly 20 or rendering the subassembly dysfunctional. The SSL Light Subassembly 20, FIG. 7 further having endcaps 203 with endcap flat bottom 203.1 surfaces at each distal end of the longitudinal housing 202. The endcap flat bottom 203.1 having a flat surface with features to accommodate alignment with the strut channel 101 slotted openings 108 opposite the opening 103 in the face of the strut channel 101 as to allow the downward J shaped support structure 104 and the spring 101.02 force to retain the SSL Light Subassembly 20 within the Strut Channel 101. The SSL Light Subassembly 20 being retained in a downward facing orientation FIG. 11C such that the subassembly light output 106 exits the strut channel 101 slotted openings 108 vertically downward and angled outward.

Figure 11D:
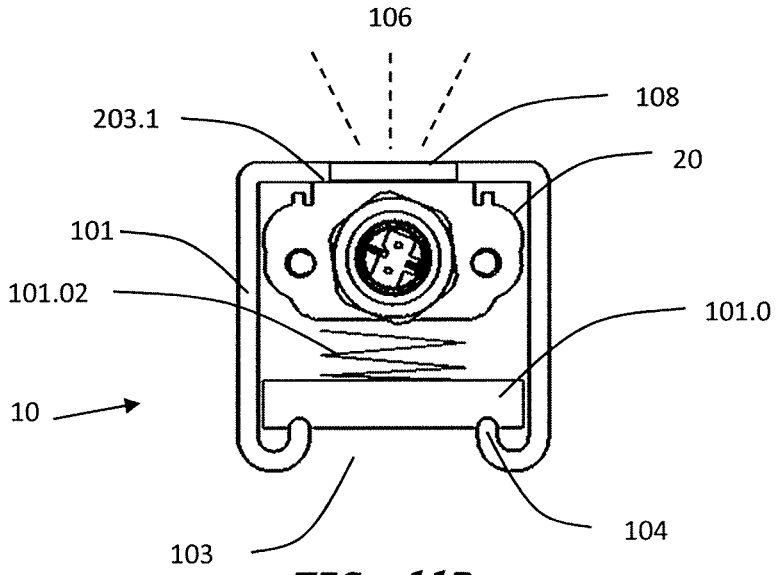
FIG. 11D SSL Light Assembly—Section View Up Lighting Thru Perforated Opening.

In other embodiments, the SSL Light Subassembly 20 FIGS. 4 & 7 having sufficient mechanical structure between the housing 202, electrical LED circuit 201, endcaps 203, sealing structure 205.1 and optics structure 204.1 to allow retention of the SSL Light Subassembly 20 within the strut channel structure 101. The SSL Light Fixture Subassembly 20 mechanically retained in the strut channel 101 utilizing traditional strut channel fasteners 101.0, FIG. 2, including but not limited to one or more spring loaded fasteners 101.0 with a flat plate 101.01, FIG. 1B positioned against the J shaped support structure 104 with the spring 101.02 compressed and pressed against the SSL Light Subassembly 20 housing top flat surface 202.2, without damaging the SSL Light Subassembly 20 or rendering the subassembly dysfunctional. The SSL Light Subassembly 20, FIGS. 4 & 7 further having endcaps 203 with endcap flat bottom 203.1 surfaces at each distal end of the longitudinal housing 202, FIG. 2. The endcap flat bottom 203.1, FIG. 11D having a flat surface with features to accommodate alignment with the strut channel 101 slotted openings 108 opposite the opening 103 in the face of the strut channel 101 as to allow the upward J shaped support structure 104 and the spring 101.02 force to retain the SSL Light Subassembly 20 within the Strut Channel 101. The SSL Light Subassembly 20 being retained in an upward facing orientation FIG. 11D such that the subassembly light output 106 exits the strut channel 101 slotted openings 108 vertically upward and angled outward.

Figure 11E:
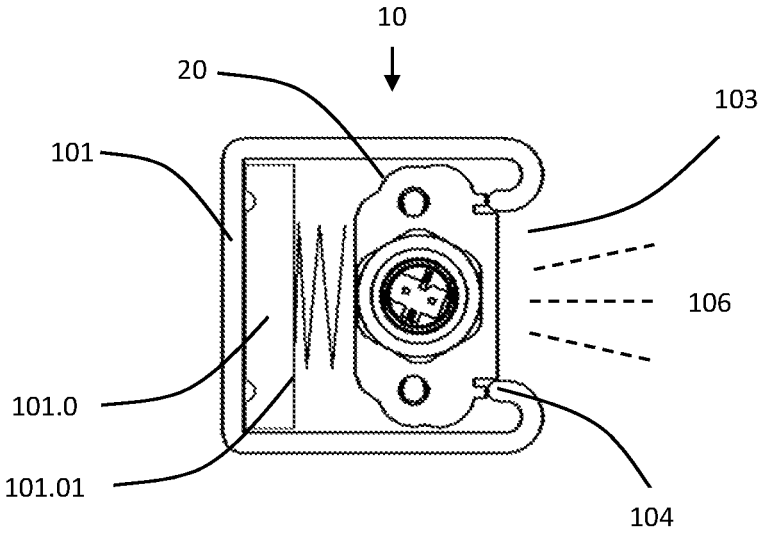
FIG. 11E SSL Light Assembly—Section View Down/Side Lighting Thru Continuous Opening.

In further embodiments, SSL Light Subassembly 20, FIG. 11E retained within the Strut Channel 101 in a horizontal position with the spring loaded fasteners 101.0 with a flat plate 101.01 positioned against the J shaped support structure 104 and as to allow light output 106 at any other angle orientation between horizontal or vertical with light output 106 exiting through either the Strut Channel 101 opening 103 or slotted openings 108.

The SSL Lighting Subassembly 20, FIG. 1A is self-contained within the physical geometry of the strut channel 101 allowing the strut channel 101 to be fully utilized in the normal intended function of a structural channel providing mechanical support for building mechanical, electrical and plumbing system components. Further, the SSL Lighting Subassembly 20, FIG. 1A is designed to allow traditional mechanical attachment of the strut channel to the building ceiling or ceiling structure without interference.

The SSL Light Subassembly 20, FIG. 1A allows for use of either traditional electrical wiring with flex or rigid conduit and conduit connectors designed for use with strut channel 101, or the development of electrical wiring connectors specifically designed to provide ease of assembly of the strut light fixture to the SSL Light Subassembly 20.

The SSL light fixture assembly physical geometry FIG. 7 is contained fully within traditional strut member types and geometries FIG. 1A providing for design optimization of limited physical space above and below the ceiling strut channel structure. The SSL lighting subassembly FIG. 4 can be continuous or segmented FIG. 6A allowing for continuous uniform lighting or lighting segments in combination with other lighting or optics solutions allowing for mixed lighting solutions. Mixed lighting solutions including spotting, wall washing, wide or narrow angle options or other combination lighting solutions.

The SSL Light Subassembly 20, FIG. 4 is of appropriate size and of sufficient rigidity as to allow assembly into the common structural channel FIG. 1A by means of direct insertion through the continuous opening 103 in the structural channel 101 or by insertion through an open end of the structural channel 101. The SSL Light Subassembly 20 is sized such to fit through the opening at an angle with the endcap flat surface 203.1, FIGS. 7 & 8 providing a smooth rigid surface for the SSL Light Subassembly 20 to slide along the inner wall 105 of the strut opening 103 while the housing flat top 202.2 provides a flat surface for the SSL Light Subassembly 20 to slide along the retention spring 101.02 retained inside the strut channel opening FIG. 1A. The SSL Light Subassembly 20 housing 202 having a semicircular indented feature 202.4, FIGS. 1B & 7 at the top corners and slightly inset from the top flat surface 202.2 allowing the SSL Light Subassembly 20 to rotate in the strut open pocket 102 without binding between the inner walls of the strut channel 101 and the retainer spring. Features on the vertical walls 202.1 of the housing extrusion 202 and endcaps 203, FIGS. 1B, 7 & 8 provide an increase finger grip force and are beneficial to manipulating the SSL Light Subassembly 20, FIGS. 4 & 16 through rotation when inserting directly through the strut channel 101 opening 103 eliminating the need for hand tools. Similarly, the features of endcap flat top 203.2 and endcap flat bottom 203.1 surfaces FIG. 7, and the endcap 203.5 and housing extrusion 202.1 finger grip features FIGS. 7 & 8, provide beneficial handling surfaces for removal of the SSL Light Subassembly 20 from the strut channel 101, FIG. 1B for servicing or realignment.

The SSL Light Subassembly 20 optics alignment system providing for a variable light output half angle from narrow to wide beam based on a combination of SSL Light Subassembly 20 and strut channel opening relative position, and variable source, internal optic or reflector, batwing or optic lens and strut channel opening configuration. Certain embodiments of the invention include but are not limited to a SSL Light Subassembly 20 and Fixture Assembly with a 45-degree half angle light output with a batwing pattern produced from an initial endcap position placing a batwing lens at a depth behind the strut channel opening to cause a portion of the light output pattern greater than 45-degree half angle to be reflected and reintroduced into the 45-degree half angle batwing pattern FIG. 16. The strut channel opening having a reflective or baffled face construction on the opening vertical legs to reflect the bulk of the light greater than 45 degree to 60 degrees at an angle placing the added reflected lighting into the batwing pattern or alternatively, if baffled, added reflected lighting directed back into the fixture FIG. 16.

Similarly, the same construction SSL Light Subassembly 20 or Fixture Assembly with the strut channel opening features described above to produce added reflected batwing or baffled lighting but with the added feature of the removal of a tab extended within the endcap alignment notches FIGS. 7 & 8. The removal of the tab extensions repositioning the SSL Light Subassembly 20 within the Fixture Assembly and relative to the strut channel opening such that the previously added light or baffled light now passes through the opening producing a 60-degree half angle light output within a batwing pattern FIG. 13.

Embodiments herein include the method of retrofitting an existing grid system 30, FIG. 3 of strut channels 101 where individual strut channels 101 can be retrofitted with the SSL Light Subassemblies 20, FIG. 4 by inserting at least one mounting hardware 101.0 into the strut channel opening 103 followed by inserting a SSL Light Subassemblies 20 directly through the opening 103 of the existing installed strut channels 101. The SSL Light Subassembly 20 being rotated into the strut channel opening 103 and retained between the hardware loaded spring 101.02 and the vertical J shaped support structure 104, FIG. 1A. The SSL Light Subassemblies 20 being electrically connected to power supply 40 in a remote electrical j-box 403 via a supply wire harness 410, FIG. 15A routed through the open space between the ceiling structure 302 and the existing grid system 30, FIG. 3 with the strut channel 101 opening 102, FIG. 1A acting as an electrical raceway for containing the wire cabling 411.

In another embodiment herein where the method of retrofitting an existing grid system 30, FIG. 3 of strut channels 101 where a new individual strut channel 101 is assembled to the existing grid systems 30 and oriented with a downward facing opening 103. The newly add strut channel 101 fitted with the SSL Light Subassemblies 20, FIG. 4 by inserting at least one mounting hardware 101.0 into the strut channel opening 103 followed by inserting a SSL Light Subassemblies 20 directly through the opening 103 of the existing installed strut channels 101. The SSL Light Subassembly 20 being rotated into the strut channel opening 103 and retained between the hardware loaded spring 101.02 and the vertical J shaped support structure 104, FIG. 1A. The SSL Light Subassemblies 20 being electrically connected to power supply 40 in a remote electrical j-box 403 via a supply wire harness 410, FIG. 15A routed through the open space between the ceiling structure 302 and the existing grid system 30, FIG. 3 with the strut channel 101 opening 102, FIG. 1A acting as an electrical raceway for containing the wire harness 411.

Dimensions disclosed herein are exemplary in embodiments. The invention includes the components with given dimensions plus or minus 5% of the given dimensions; in embodiments, plus or minus 10% of the given dimensions. The light units may be 9" to 96". In an embodiment the light units are 4 feet long with 45" of lighted length.

The invention is not restricted to the details of the foregoing embodiment (s). The invention extends to any novel one, or any novel combination, of the features disclosed in this specification (including any incorporated by reference references, any accompanying claims, abstract and drawings), or to any novel one, or any novel combination, of the steps of any method or process so disclosed The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

The invention claimed is:

1. A light fixture assembly of a U-shaped channel and an elongate insertable light unit, U-shaped channel having an upper wall portion, a pair of side wall portions, each side wall portion having a wall portion edge turned inwardly defining a channel opening having a channel opening width, the channel opening leading to an open channel interior, the open channel interior having a width greater than the channel opening width;

an elongate insert light unit comprising an elongate housing defining a longitudinally extending channel recess and an open bottom, the elongate housing having a pair of ends, a strip of light emitting diodes seated within the recess and directed outwardly toward the open bottom, a pair of end caps, one end cap of the pair at each end of the elongate housing, a transparent lens captured within the housing, a power cable connected to the strip of light emitting diodes and extending out of one of the end caps;

the elongate insert light unit having a height that is less than the channel opening width, and having a width that is greater than the channel opening width, whereby the elongate insert light unit may be inserted into the channel when the channel is secured and with the channel opening facing downward, by inserting a lateral side of the elongate insert light unit first through the channel opening and then rotating the channel about 90 degrees so that the elongate insert light unit may seat on the wall portion edges.

2. The light fixture assembly combination of claim 1, wherein elongate insert light units each conforms to channel opening defined by pair of wall portion edges.

3. The light fixture assembly of claim 1, wherein the pair of endcaps of the light unit has a profile in an end view that circumscribes the profile of the elongate housing.

4. The light fixture assembly of claim 3, wherein each endcap is seatable on a seat defined by the wall edge portions whereby the elongate housing is not contacting the U-shaped channel.

5. The light fixture assembly of claim 1 wherein the light unit is entirely contained within the open channel interior of the U-shaped channel.

6. The light fixture assembly of claim 1, further comprising a spring retention members positionable above the light unit for securing the said light unit on a seat of the U-shaped channel, the seat defined by the wall portion edges.

7. The light fixture assembly of claim 6 wherein the spring member is a coiled spring and is positionable between a surface of the light unit opposite a light emitting side and engages an inside facing surface of the upper wall of the U-shaped channel opposite the channel opening.

8. The light fixture assembly of claim 1, further comprising a plurality of the U-shaped channels arrangeable into a grid system and further comprises a plurality of the light units fitable into the U-shaped channels.

9. The light fixture assembly of claim 8 further comprising a plurality of metal boxes attachable to the plurality of U-shaped channels, and the combination further comprises a plurality of power units, each power unit positionable in one of the metal boxes and electrically connectable to one of the plurality of light units.

10. The light fixture assembly of claim 9 wherein the plurality of U-channels are arranged into the grid system and the plurality of light units are fitted into the U-shaped channels.

11. A combination ceiling grid system and a plurality of elongate insert light units, the grid system comprising a multiplicity of steel elongate channels arranged in a grid, the grid suspended below and spaced from a ceiling, a plurality of the channels having a downwardly directed U-shape and defining a channel opening and an open channel interior, the channel having an upper horizontal wall portion adjoining an opposing pair of J-shaped wall portions, each J-shaped wall portion with an inwardly directed curved lip portion, each pair of J-shaped wall portions of each channel defining a channel opening width therebetween, an upwardly facing light unit seat, and an interior channel width;

each of the plurality of elongate insert light units being seated within the open channel interior of one of the steel elongate channels on the respective upwardly facing seat of said channel, each elongate insert light unit having an elongate housing defining a longitudinally extending recess, the elongate housing having a pair of ends, a strip of light emitting diodes seated within the recess, a pair of end caps, one cap of the pair at each end of the elongate housing, a transparent lens captured within the housing;

wherein each of the plurality of elongate insert light units having a maximum width measured horizontally that is greater than the channel opening width and less than the interior channel width whereby each of said insert light units is captured within the respective channel;

wherein each insert light unit having a maximum height measured vertically and said maximum height is less than the channel opening width permitting rotation of the light unit within the recess and then removal of the light unit out of the channel opening.

12. The combination of claim 11, wherein elongate insert light units each conforms to channel opening defined by the curved lip portions of the pair of J-shaped wall portions.

13. The combination of claim 11, wherein the endcaps of each light unit have a profile in an end view that circumscribes the profile of the elongate housing.

14. The combination of claim 13, wherein each endcap is seated on the seat of the respective elongate channel and the housing is not in contact with the respective channel defining a gap therebetween.

15. The combination of claim 11 wherein each light unit is entirely contained within the open channel interior of the U-shaped channel.

16. The combination of claim 11, further comprising a plurality of spring retention members with one of said plurality of springs positioned above each light unit for securing the said light unit on the seat of the respective channel.

17. The combination of claim 16 wherein the spring member is a coiled spring and is positioned between a surface of the light unit opposite the light emitting side and engages an inside facing surface of the upper wall of the U-shaped channel opposite the channel opening.

18. The combination of any of claim 11, wherein the grid system further comprises a plurality of metal boxes attached to a plurality of the multiplicity of steel elongate channels, and the combination further comprises a plurality of power units, each power unit positioned in one of the metal box and electrically connected to one of the plurality of light units.

19. A light fixture assembly comprising a U-shaped channel and an elongate insertable light unit, U-shaped channel having an upper wall portion, a pair of side wall portions, each side wall portion having a wall portion edge turned inwardly defining a channel opening having a channel opening width, the channel opening leading to an open channel interior, the open channel interior having a width greater than the channel opening width;

an elongate insert light unit having a strip of light emitting diodes in a housing, the elongate insert light unit having a height that is less than the channel opening width, and having a width that is greater than the channel opening width, whereby the elongate insert light unit may be inserted into the channel when the channel is secured and with the channel opening facing downward, by inserting a lateral side of the elongate insert light unit first through the channel opening and then rotating the elongate insert light unit about 90 degrees so that the elongate insert light unit seats on the wall portion edges.

20. The combination of claim 19 wherein power wires extend out of the elongate insert light unit and run down the channel interior and exit the channel interior.

* * * * *